US008744295B2

(12) United States Patent
Fukamachi

(10) Patent No.: US 8,744,295 B2
(45) Date of Patent: Jun. 3, 2014

(54) IMAGE FORMING APPARATUS AND IMAGE FORMING SYSTEM

(75) Inventor: Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 13/212,372

(22) Filed: Aug. 18, 2011

(65) Prior Publication Data

US 2012/0045236 A1 Feb. 23, 2012

(30) Foreign Application Priority Data

Aug. 23, 2010 (JP) ..... 2010-186372

(51) Int. Cl.
*G03G 15/08* (2006.01)

(52) U.S. Cl.
USPC ..... 399/53

(58) Field of Classification Search
USPC ..... 399/39, 40, 53, 55, 341
See application file for complete search history.

(56) References Cited

U.S. PATENT DOCUMENTS

| | | | | |
|---|---|---|---|---|
| 7,933,544 | B2 | 4/2011 | Nishikata et al. | |
| 2003/0007814 | A1 * | 1/2003 | Richards | 399/341 |
| 2006/0222390 | A1 * | 10/2006 | Sasaki et al. | 399/55 |
| 2007/0280760 | A1 | 12/2007 | Nishikata et al. | |
| 2008/0298860 | A1 * | 12/2008 | Omata | 399/321 |
| 2009/0207429 | A1 | 8/2009 | Iguchi | |
| 2011/0170887 | A1 | 7/2011 | Nishikata et al. | |

FOREIGN PATENT DOCUMENTS

| | | | |
|---|---|---|---|
| JP | 9-200551 | A | 7/1997 |
| JP | 2007-328023 | A | 12/2007 |
| JP | 2009-190336 | A | 8/2009 |

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

A transparent toner image printing apparatus includes a photosensitive member, an exposing device to expose the photosensitive member based on image information to form an electrostatic image, a developing device to develop the electrostatic image on the photosensitive member to form a transparent toner image using a two component developer, and a voltage applying device to apply a DC voltage biased with an AC voltage to the developing device. In addition, a transferring device transfers the transparent toner image on the photosensitive member onto a non-preprinted sheet or a preprinted sheet, a fixing device heat-fixes the transparent toner image on the non-preprinted sheet or the preprinted sheet in a fixing nip thereof, and a selecting device selects a first mode in which the transparent toner image is formed on the preprinted sheet or a second mode in which the transparent toner image is formed on the non-preprinted sheet. A controlling device controls an operation of the voltage applying device so that an amplitude of the AC voltage in the first mode is larger than an amplitude of the AC voltage in the second mode.

13 Claims, 19 Drawing Sheets

(a)

(b)

IMAGE FORMING APPARATUS AND IMAGE FORMING SYSTEM

FIELD OF THE INVENTION AND RELATED ART

The present invention relates to an image forming apparatus capable of executing an operation in an image forming mode in which a toner image is transferred onto a fixed image and then is fixed, and an image forming system including the image forming apparatus.

The image forming apparatus capable of outputting a full-color image after a recording material on which plural color toner images are transferred is heated and pressed and thus the toner images are fixed on the recording material has been widely used. In the case where a photographic image is outputted by using the full-color image, a white background portion, for an image, which is not covered with the full-color image is required to provide glossiness which is no different from that at a full-color image portion. For this reason, an image forming apparatus in which an exposed portion of the recording material is covered with a transparent toner image developed from an electrostatic image with a developer containing a transparent toner and a carrier and then the transparent toner image is fixed to effect glossing of the white background portion for the image is put into practical use (Japanese Laid-Open Patent Application (JP-A) Hei 9-200551).

Further, an image forming system in which an optional image forming apparatus for transparent is connected, at a downstream side, to a general-purpose image forming apparatus and the transparent toner image is transferred onto the whole surface of the fixed image outputted from the general-purpose image forming apparatus and then is fixed is also put into practical use (JP-A 2007-328023).

Further, as a method in which the transparent image is used, the method is not limited to the glossing of the white background portion for the image but various image forming modes are proposed correspondingly to various purposes (JP-A 2009-190336).

However, as a result of study by the present inventor, when the transparent toner image is transferred and fixed on the full-color fixed image, compared with the case where the transparent toner image is transferred and fixed on an unfixed image or the recording material, it turned out that an apparent image quality was lowered. That is, when the transparent toner image is transferred and fixed on the full-color fixed image, spots with low glossiness and low transparency are formed over the image and are liable to be observed as color unevenness.

SUMMARY OF THE INVENTION

A principal object of the present invention is to provide an image forming apparatus and an image forming system which are capable of ensuring an apparent image quality, comparable to the case where a transparent toner image is transferred and fixed on an unfixed image or a recording material, even when the transparent toner image is transferred and fixed on a fixed image.

Accordingly, an aspect of the present invention is to provide an image forming apparatus comprising:

an image bearing member;

a developing device, accommodating a developer which includes a transparent toner and a carrier, for developing with the transparent toner an electrostatic image formed on the image bearing member;

a transferring device for transferring a transparent toner image, obtained by development of the electrostatic image by the developing device, from the image bearing member onto a surface of a recording material;

a heating device for heating the transparent toner image, transferred on the surface of the recording material, in contact with the transparent toner image;

switching means for switching execution of an operation in a first image forming mode in which the transparent toner image is transferred by the transferring device onto the surface of the recording material having an already fixed non-transparent toner image is and then is heated by the heating device and execution of an operation in a second image forming mode in which the transparent toner image is transferred by the transferring device onto the surface of the recording material having an unfixed non-transparent toner image or having no image and then is heated by the heating device; and control means for controlling the developing device so that a developing condition such that transfer of the carrier from the developing device onto the image bearing member during the execution of the operation in the first image forming mode is more suppressed than that during the execution of the operation in the second image forming mode.

These and other objects, features and advantages of the present invention will become more apparent upon a consideration of the following description of the preferred embodiments of the present invention taken in conjunction with the accompanying drawings.

Figure 4:
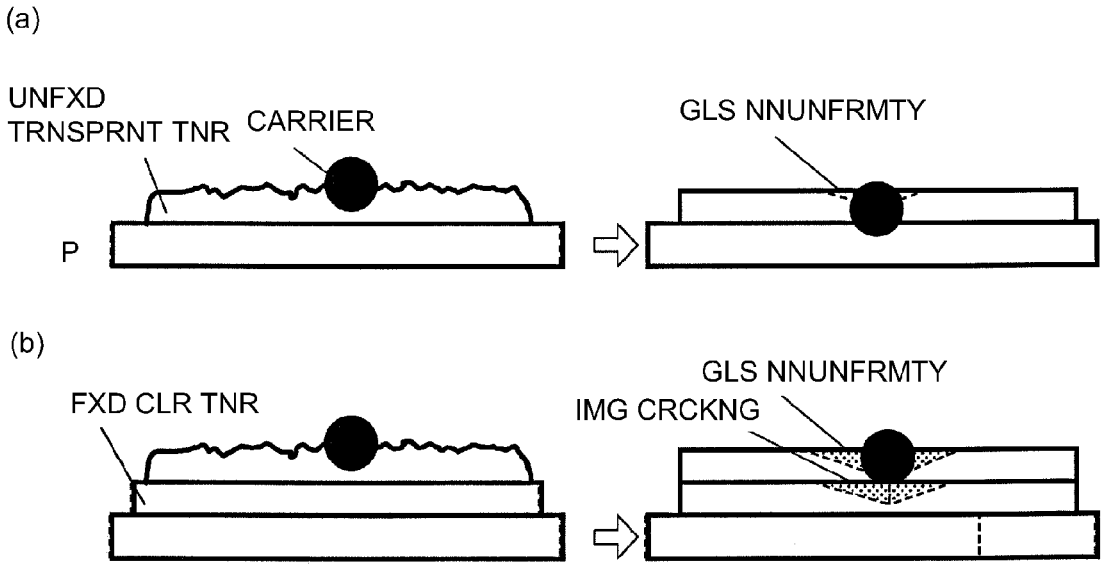

Parts (a) and (b) of FIG. 4 are illustrations of behavior of a toner before and after fixing when carrier deposition occurs.

Figure 5:
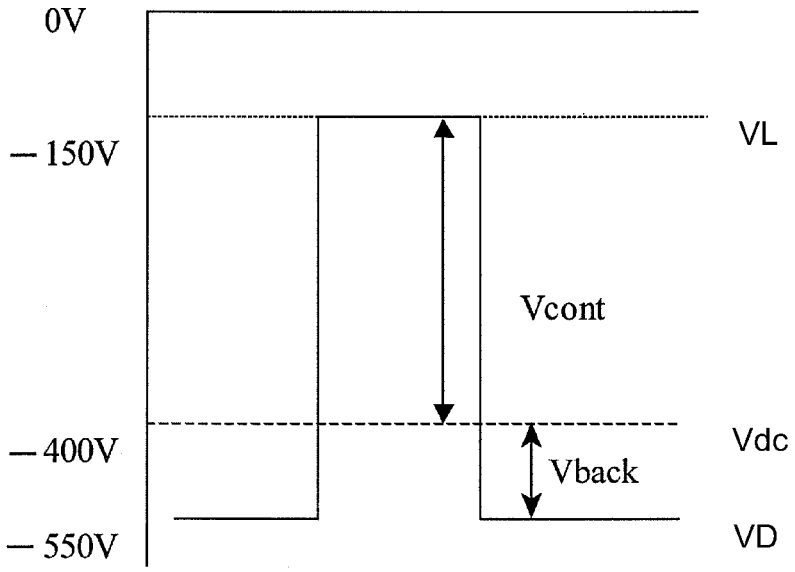

FIG. 5 is an illustration of respective portion potential during development.

Figure 6:
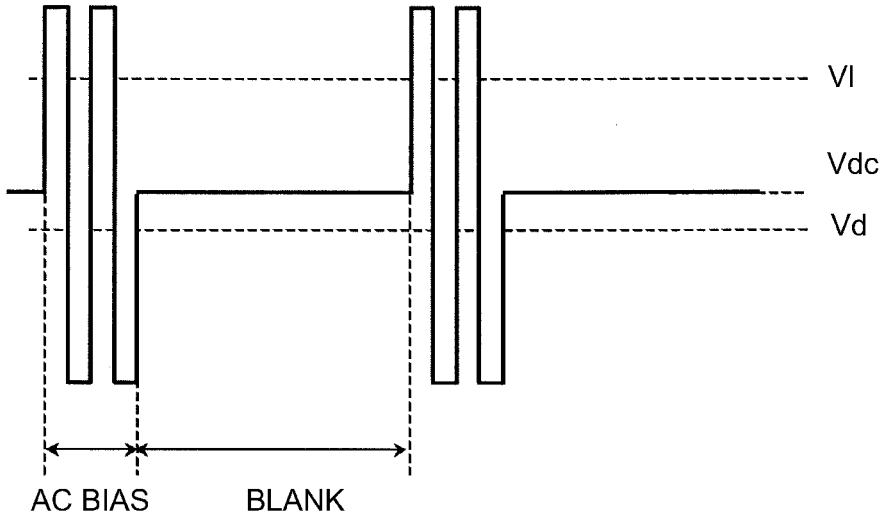
Figure 6:
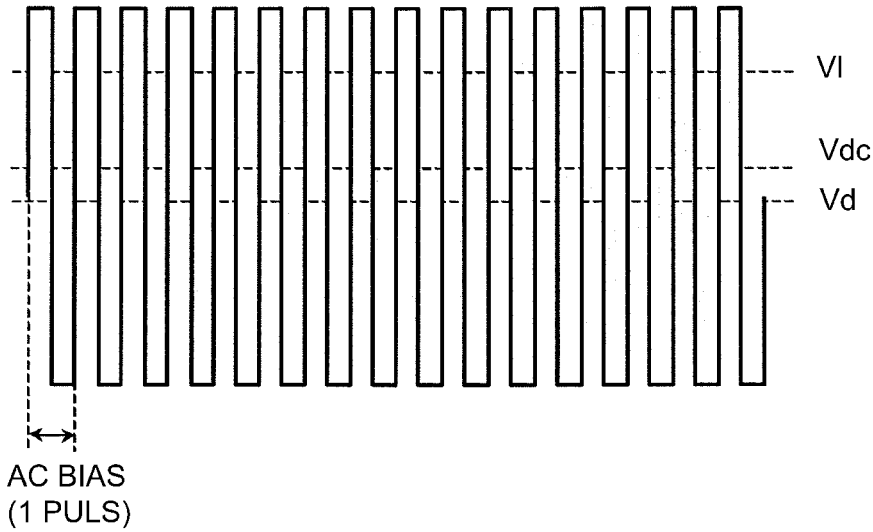

Parts (a) and (b) of FIG. 6 are illustrations of two types of AC voltages.

Figure 7:
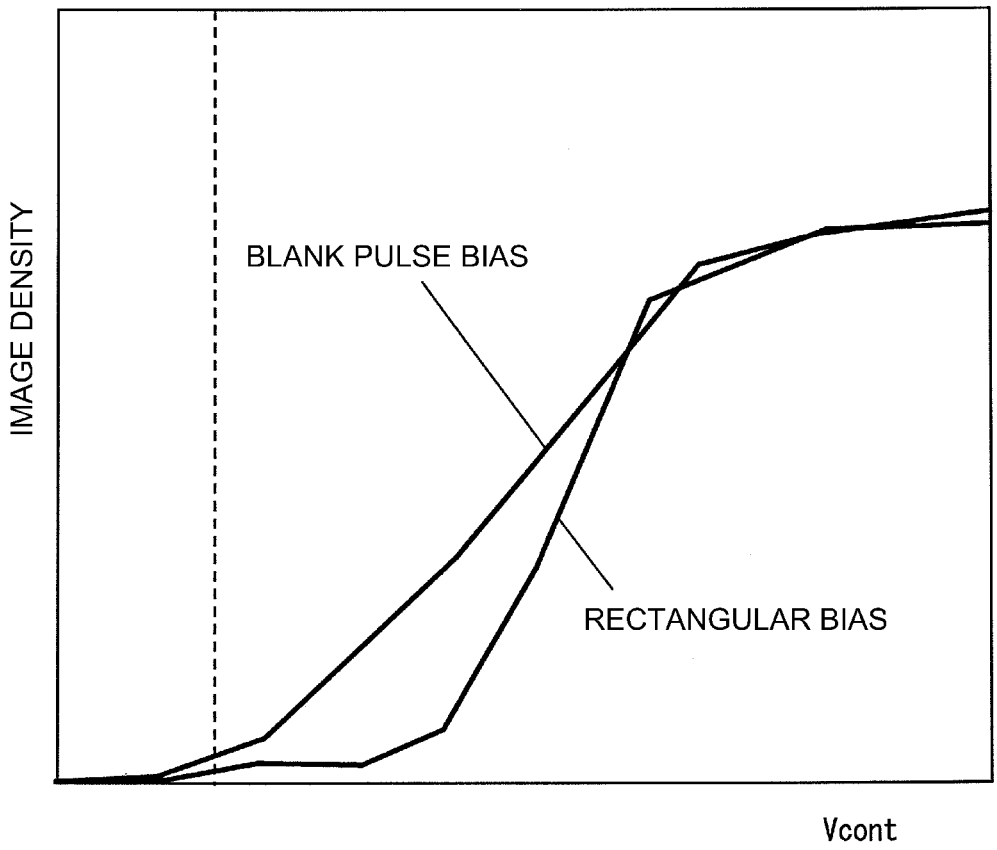

FIG. 7 is a graph for illustrating a developing property of the two types of AC voltages.

Figure 8:
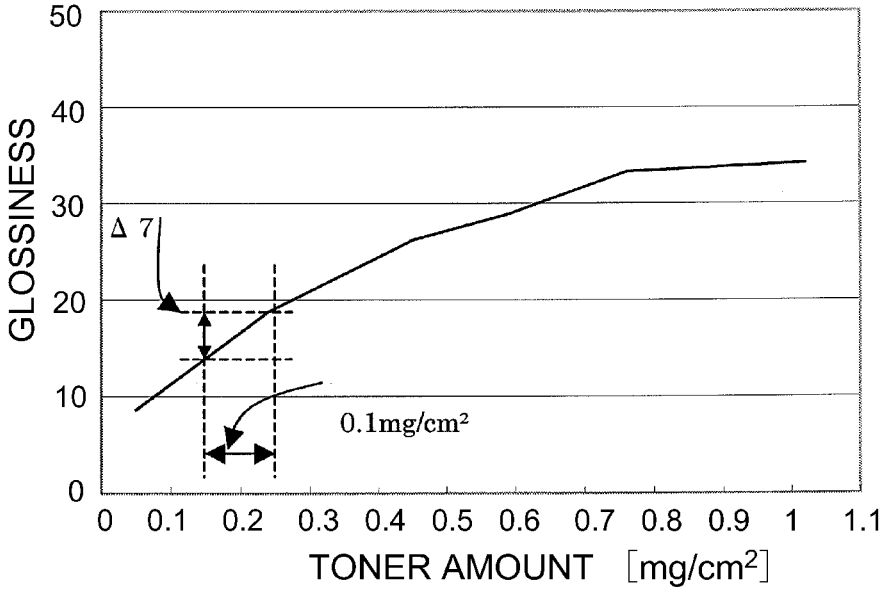

FIG. 8 is a graph showing a relationship between a toner amount per unit area and glossiness of a transparent toner image.

Figure 9:
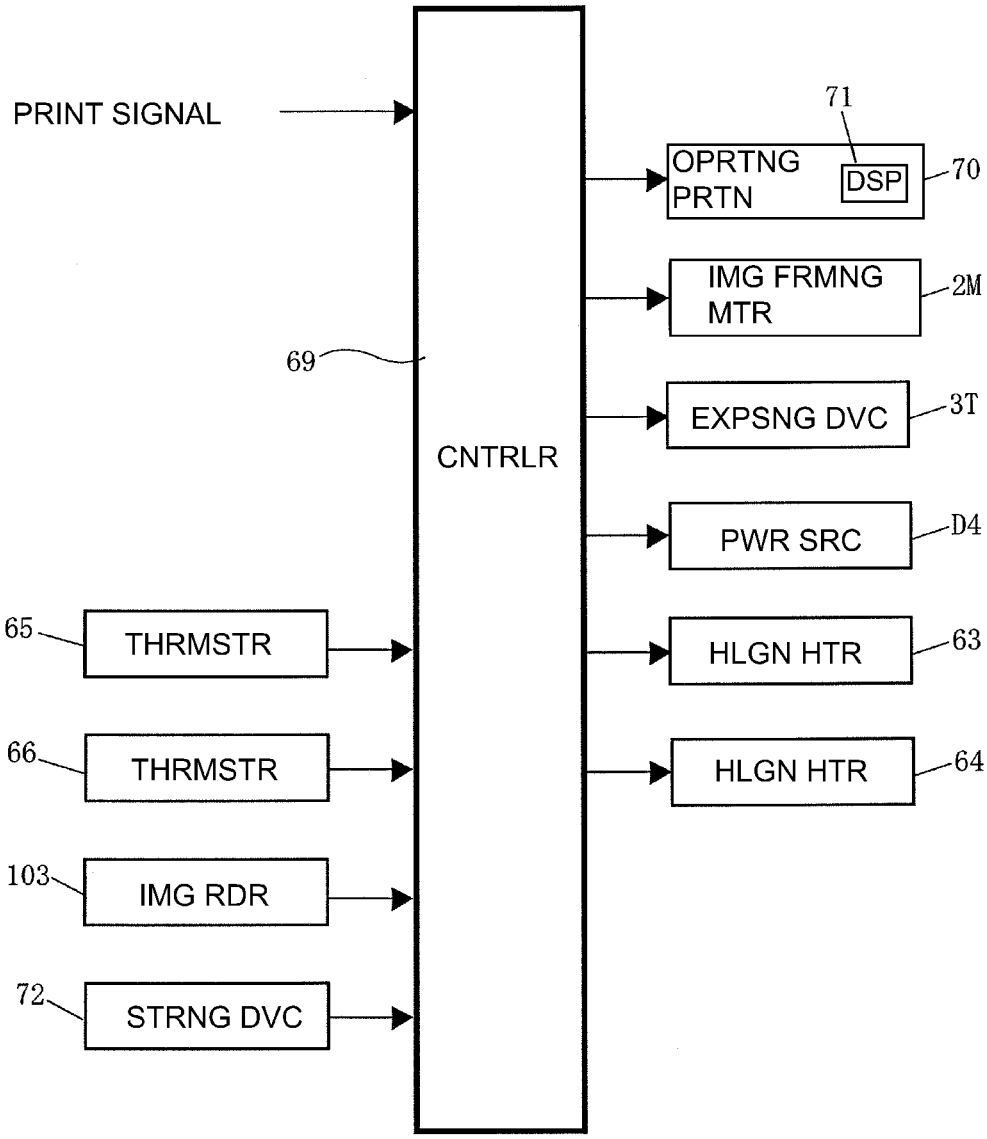

FIG. 9 is a block diagram of an image forming system.

Figure 10:
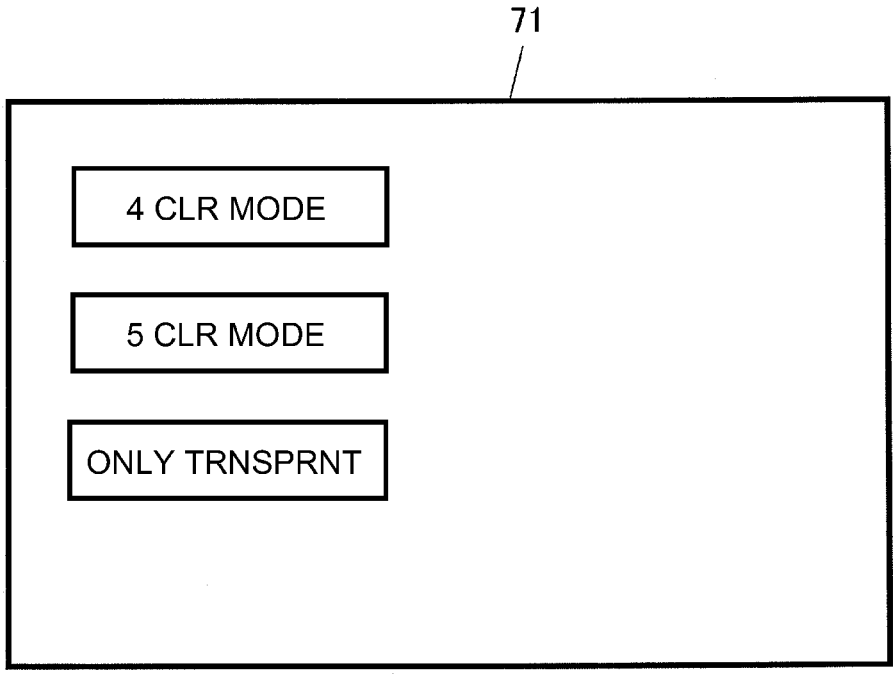

FIG. 10 is an illustration of a mode selection screen on an operating panel.

Figure 11:
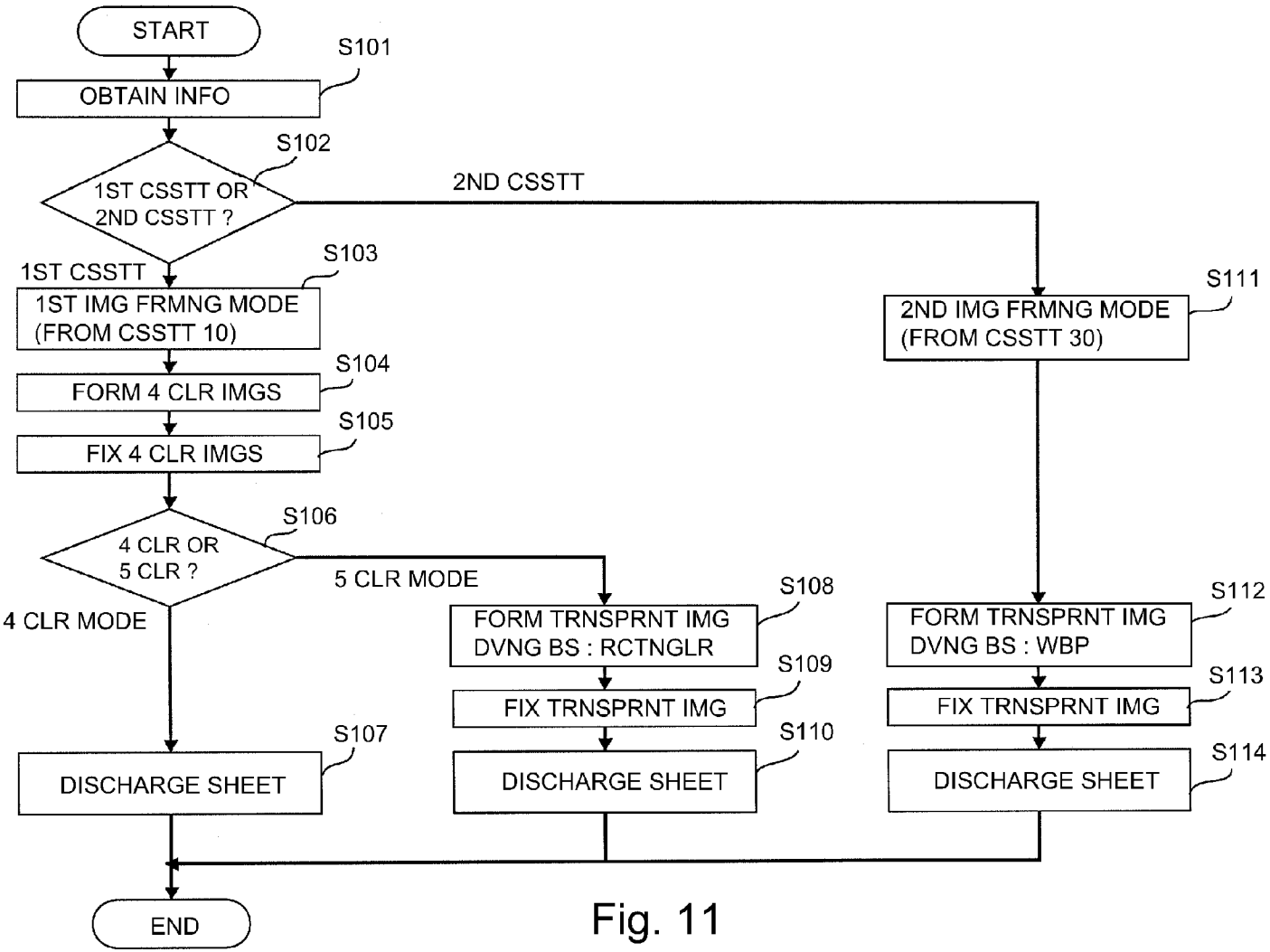

FIG. 11 is a flow chart of control in Embodiment 1.

Figure 12:
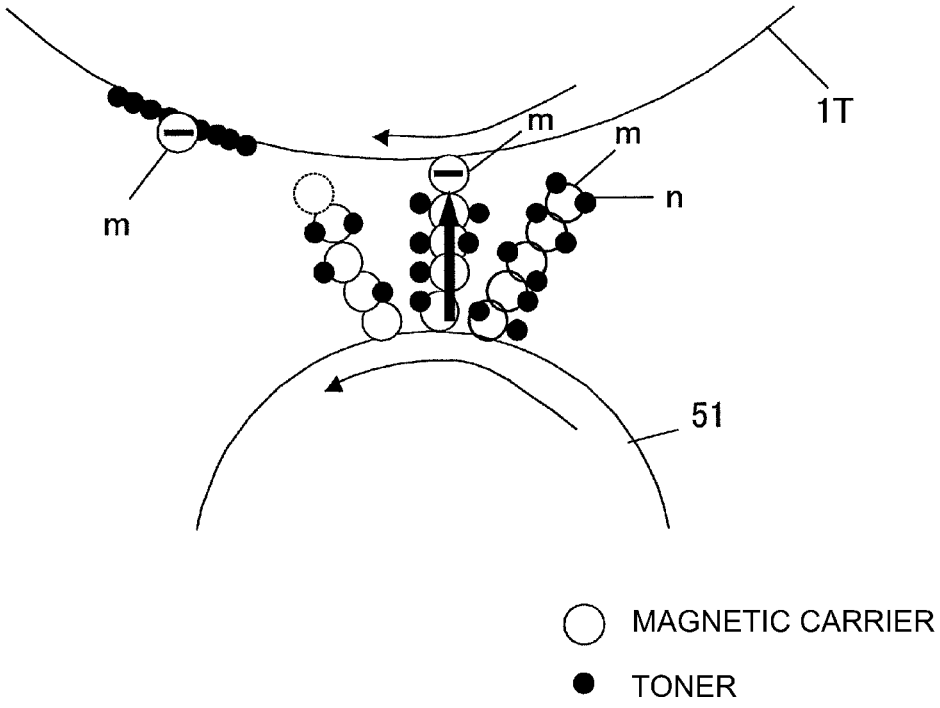

FIG. 12 is an illustration of carrier deposition.

Figure 13:
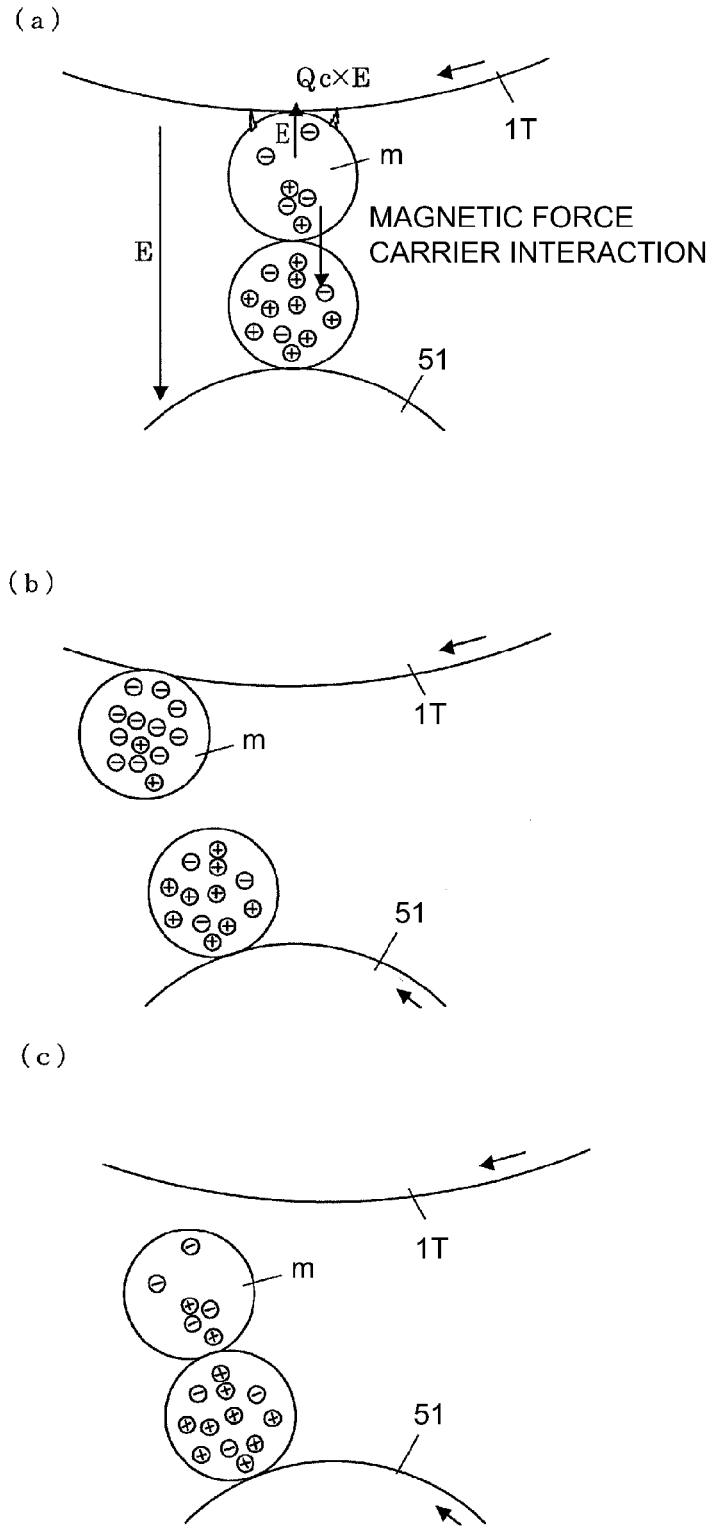

Parts (a) to (c) of FIG. 13 are illustrations of charge injection into a carrier.

Figure 14:
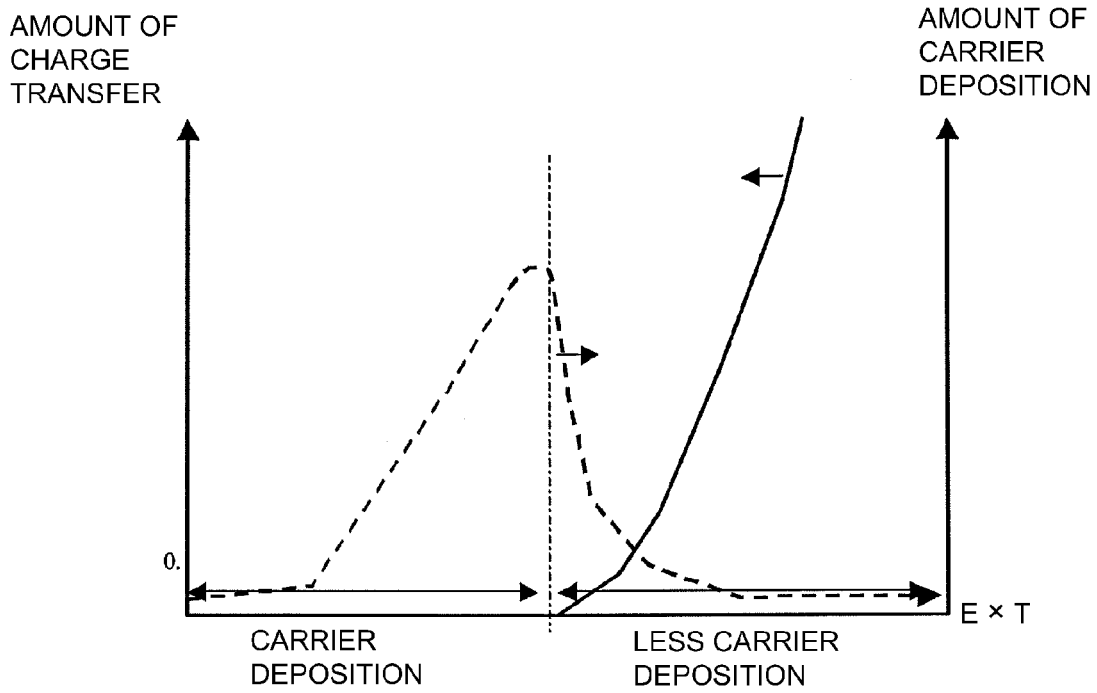

FIG. 14 is a graph showing a relationship between an AC voltage waveform and an amount of carrier deposition.

Figure 15:
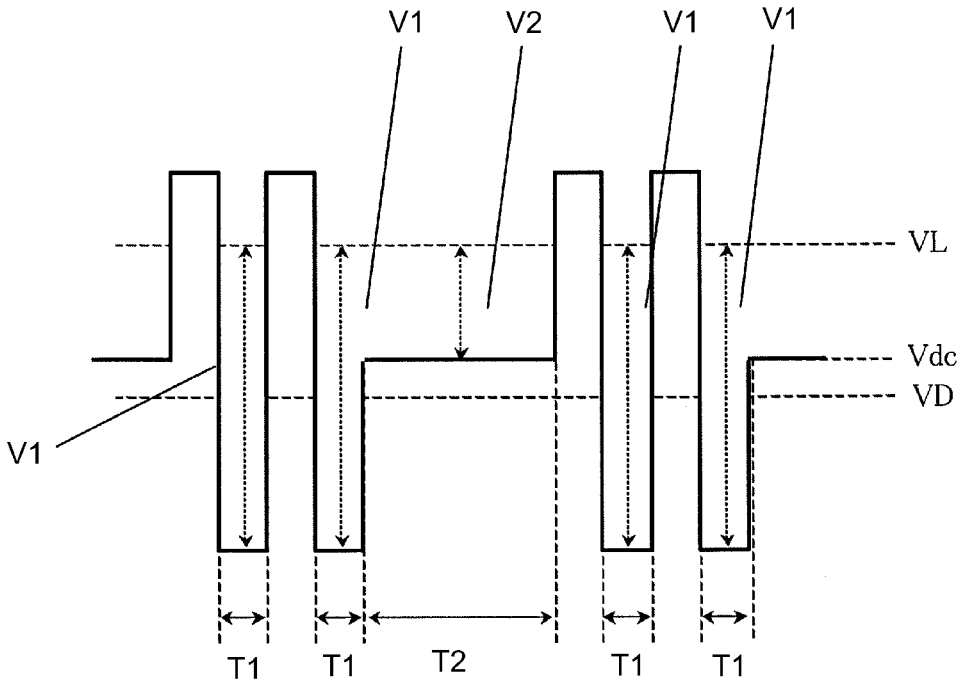

FIG. 15 is an illustration of a double blank pulse.

Figure 16:
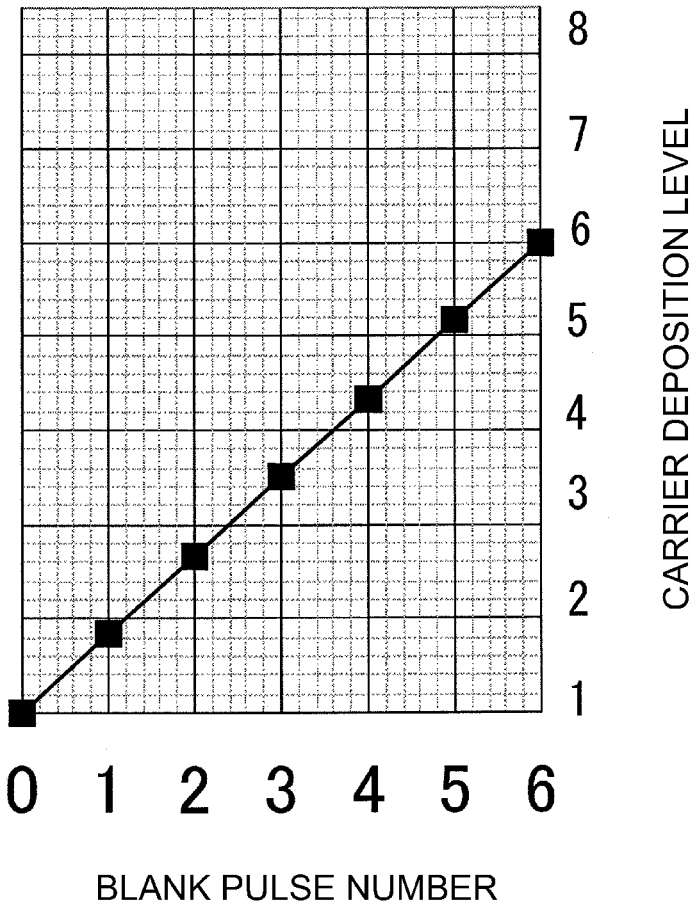

FIG. 16 is a graph showing a relationship between the number of blank pulses and a carrier deposition level.

Figure 17:
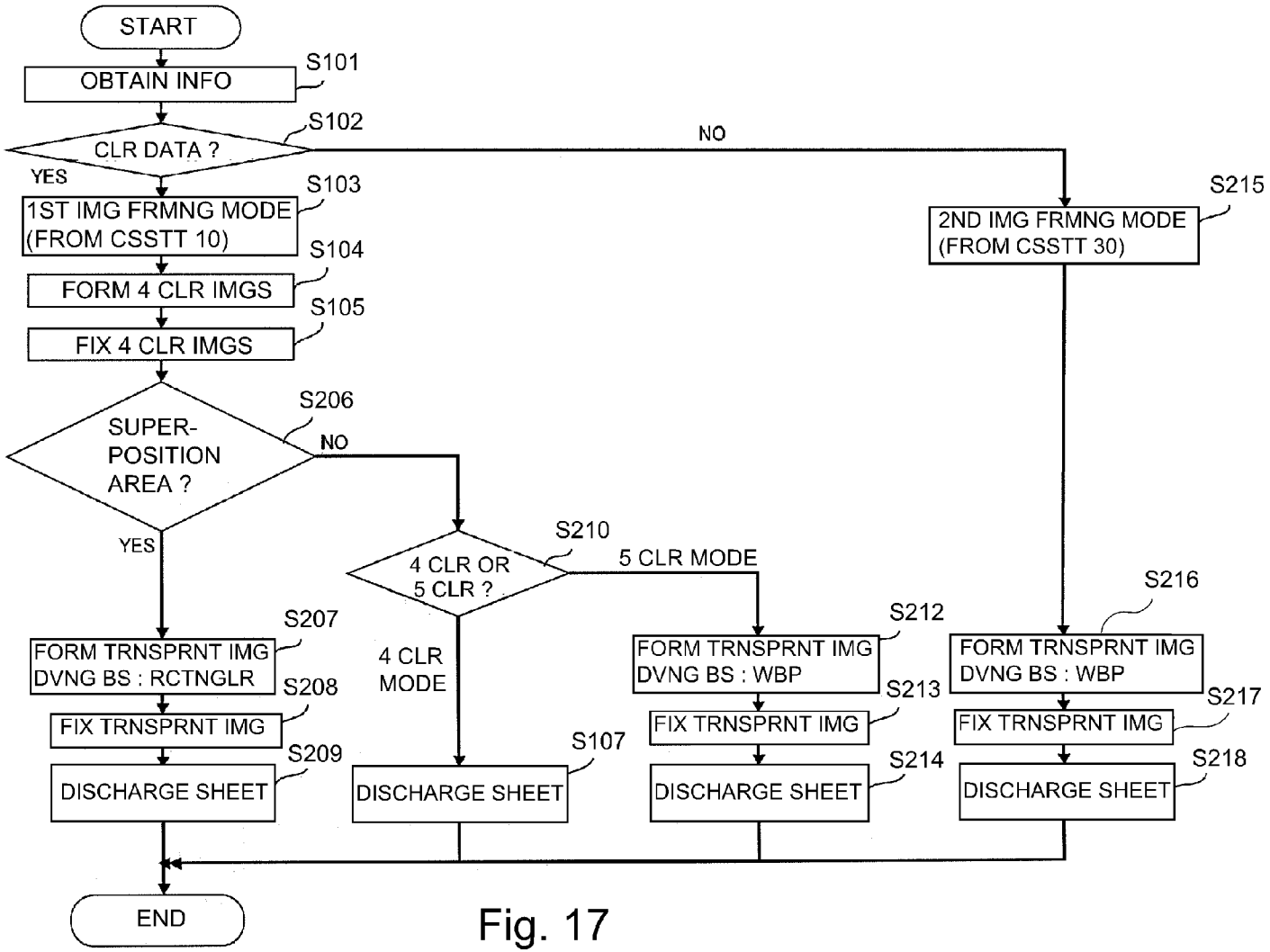

FIG. 17 is a flow chart of control in Embodiment 2.

Figure 18:
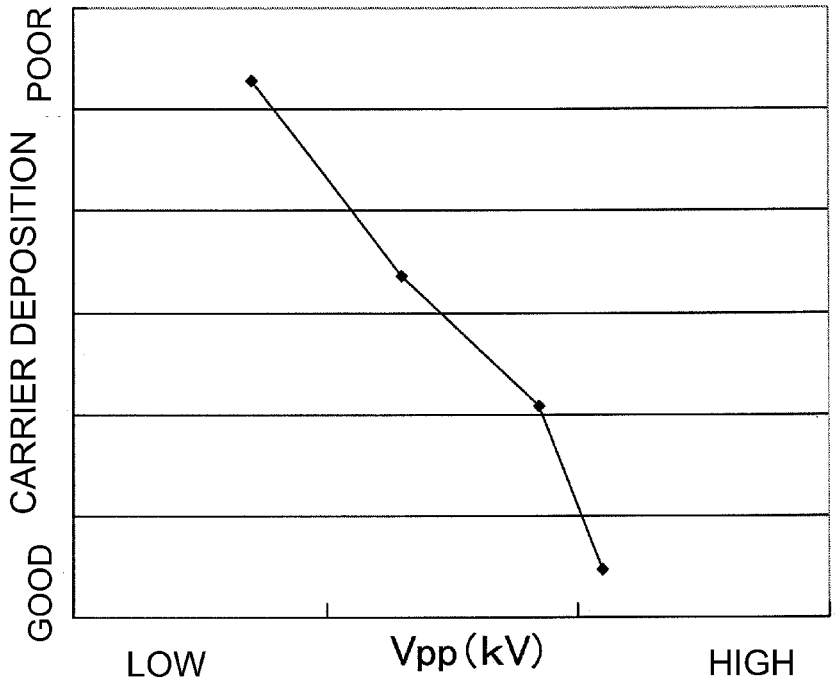

FIG. 18 is an illustration of a developing voltage parameter used in Embodiment 3.

Figure 19:
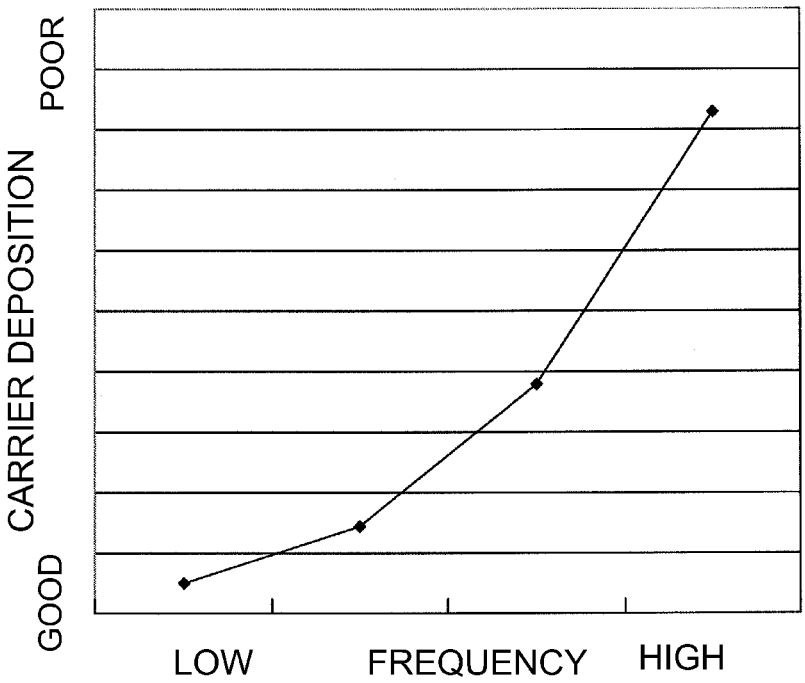

FIG. 19 is an illustration of a developing voltage parameter used in Embodiment 4.

DESCRIPTION OF THE PREFERRED EMBODIMENTS

Embodiments of the present invention will be described with reference to the drawings. The present invention can be also be carried out in other embodiments in which a part or all of constituent elements of the following embodiments are replaced with their alternative constituent elements so long as a developing voltage is changed between the case where a transparent toner image is transferred onto a fixed image and the case where the transparent toner image is transferred onto a recording material.

Therefore, an image forming portion for forming and transferring a toner image on a recording material can be carried out irrespective of a charging type, a transfer type, a cleaning type, an intermediary transfer type, a recording material conveying type, one-drum type and a tandem type.

Further, the image forming apparatus is not limited to a transparent image forming apparatus connected at downstream side to a general-purpose full-color image forming apparatus but may also be carried out as a single transparent image forming apparatus in which a recording material on which a fixed image is formed is accommodated in a recording material cassette and then the transparent toner image is formed.

Further, the image forming apparatus is not limited to the transparent image forming apparatus using a two-component developer containing a transparent toner and a carrier but may also be carried out as an image forming apparatus capable of executing an additional printing job in which a toner image of a single color or a plurality of colors is formed with the two-component developer and then is transferred onto a fixed image. In place of the transparent toner, a toner of a special color tone such as gold, silver, white or specific intermediate color.

In this embodiment, only a principal portion relating to formation and transfer of the toner image will be described but the present invention can be carried out by image forming apparatuses for various purposes, such as printers, various printing machines, copying machines, facsimile machines and multi-function machines, by adding necessary equipment, device and casing structure.

Incidentally, general matters of the image forming apparatuses and image forming systems described in JP-A Hei 9-200551, JP-A 2007-328023 and JP-A 2009-190336 will be omitted from illustration and description.

<Image Forming Apparatus>

Figure 1:
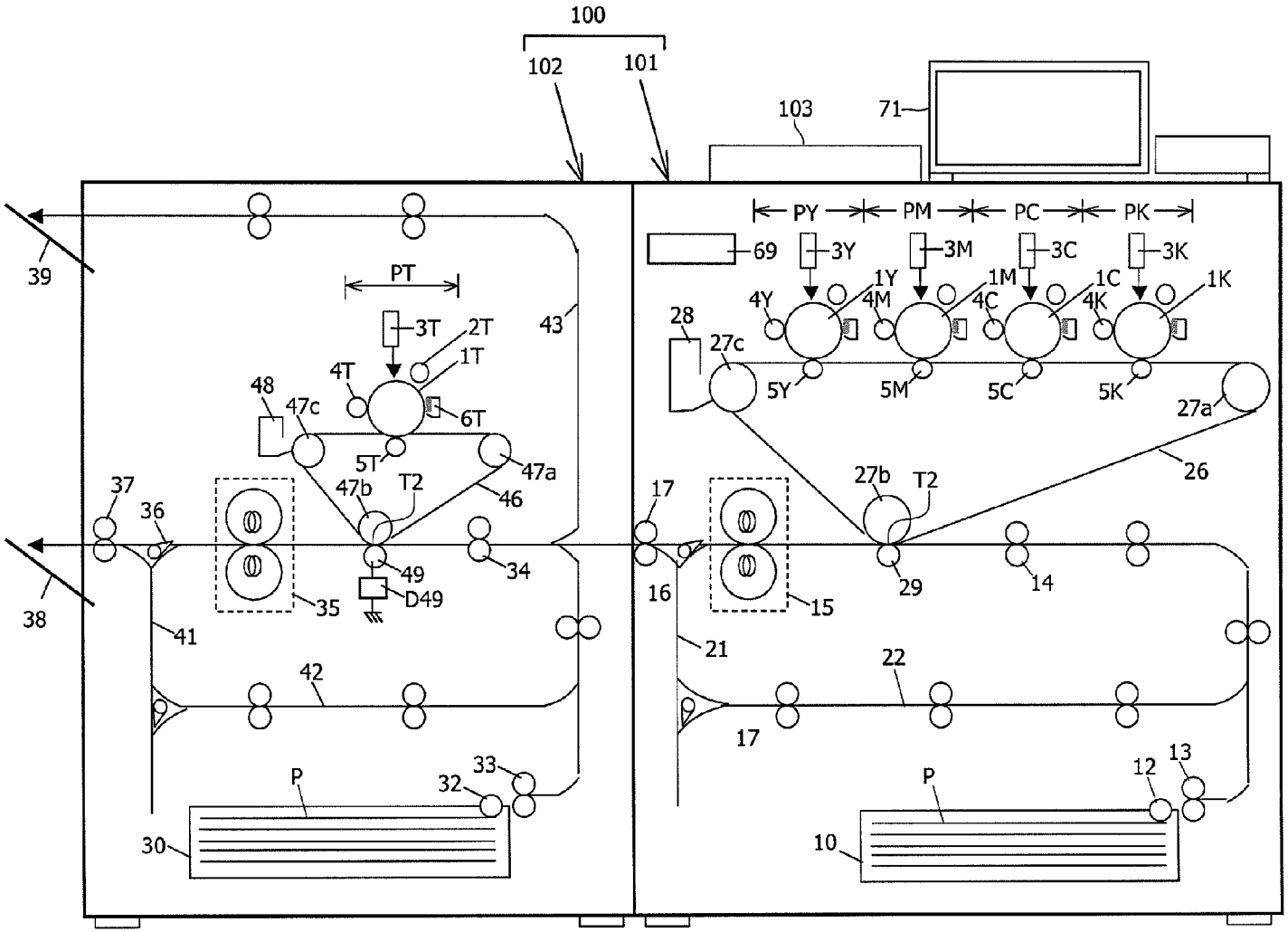
FIG. 1 is an illustration of a structure of an image forming apparatus.

FIG. 1 is an illustration of a structure of an image forming system 100. As shown in FIG. 1, the image forming system 100 is constituted by connecting an optional transparent image forming apparatus 102, at a downstream side, to a general-purpose color image forming apparatus 101. In the color image forming apparatus 101, toner images constituting a full-color image are formed on an intermediary transfer belt 26 and are transferred onto a recording material P and are heated and pressed on the recording material P by a fixing device 15 and thus the full-color image is fixed on the recording material P. In the transparent image forming apparatus 102, the toner image for a transparent image is formed on an intermediary transfer belt 46 and is transferred onto the recording material P and then is heated and pressed on the recording material P by a fixing device 35 and thus the transparent image is fixed on the recording material P.

The color image forming apparatus 101 is a tandem-type full-color image forming apparatus of an intermediary transfer type in which image forming portions PY for yellow, PM for magenta, PC for cyan and PK for black are provided.

At the image forming portion PY, a yellow toner image is formed on a photosensitive drum 1Y and is primary-transferred onto the intermediary transfer belt 26. At the image forming portion PM, a magenta toner image is formed on a photosensitive drum 1M and is primary-transferred onto the intermediary transfer belt 26. At the image forming portions PC and PK, a cyan toner image and black toner image are formed on photosensitive drums 1C and 1K, respectively, and are primary-transferred onto the intermediary transfer belt 26.

The four color toner images, for a full-color image, superposedly transferred on the intermediary transfer belt 26 are conveyed to a secondary transfer portion T2 by rotation of the intermediary transfer belt 26 and are collectively secondary-transferred onto the recording material P.

The recording material P picked up from a recording material cassette 10 by a pick-up roller 12 is separated one by one by a separating roller 13 and is conveyed to a registration roller 14. The registration roller 14 sends the recording material P to the secondary transfer portion T2 in synchronism with the toner images on the intermediary transfer belt 26. As a feeding mechanism of the recording material P, in addition to the recording material cassette 10, a manual feeding tray is available and a sheet feeding deck is also used as an option device.

The recording material P on which the full-color toner image is secondary-transferred is subjected to heat-pressing by the fixing device 15, so that the full-color toner image is fixed on the recording material P and then the recording material P is sent into the transparent image forming apparatus 102 via a discharging roller 17.

Incidentally, a leading end and trailing end of the recording material P are replaced by a flapper 16 and a reverse conveyance path 21 to turn the recording material P upside down and in this state, the recording material P can be sent into the transparent image forming apparatus 102. The recording material P on which the full-color image is formed on the front surface is fed to the registration roller 14 in a state in which the recording material P is turned upside down by using the flapper 16, the reverse conveyance path 21 and a back surface (side) conveyance path 22 and then the full-color toner image is transferable onto also the back surface of the recording material P. In the case where the image is formed on one surface (side) of the recording material P, the flapper 16 prevents the recording material P to enter the reverse conveyance path 21 and thus guides the recording material P to the discharging roller 17. In the case where the image is formed on both surfaces (sides) of the recording material P, the flapper 16 prevents the recording material P to enter the discharging roller 17 and thus guides the recording material P to the reverse conveyance path 21.

The transparent image forming apparatus 102 is the image forming apparatus of the intermediary transfer type in which the image forming portion PT for transparent (clear) is provided along the intermediary transfer belt 46. At the image forming portion PT, the transparent toner image is formed on a photosensitive drum 1T and then is primary-transferred onto the intermediary transfer belt 46. The transparent toner image transferred on the intermediary transfer belt 46 is conveyed to a secondary transfer portion T2 by rotation of the intermediary transfer belt 46 and then is secondary-transferred onto the recording material P on which the full-color image is fixed in the color image forming apparatus 101.

The recording material P on which the transparent toner image is secondary-transferred is subjected to heat and pressure by the fixing device 35 and thus the transparent toner image is fixed on the recording material P and thereafter the recording material P is discharged and stacked on a discharge tray 38 through a discharging roller 37.

Incidentally, without using the color image forming apparatus 101, the transparent toner image can be formed also by the transparent image forming apparatus alone.

The recording material P picked up from a recording material cassette 30 of the transparent image forming apparatus 102 by a pick-up roller 32 is separated one by one by a separating roller 33 and is conveyed to a registration roller 34. The registration roller 34 sends the recording material P to the secondary transfer portion T2 in synchronism with the toner images on the intermediary transfer belt 26.

Further, a leading end and trailing end of the recording material P are replaced by a flapper 36 and a reverse conveyance path 41 to turn the recording material P upside down and in this state, the recording material P can be stacked on the discharge tray 38. The recording material P on which the transparent image is formed on the front surface is fed to the registration roller 34 in a state in which the recording material P is turned upside down by using the flapper 36, the reverse conveyance path 41 and a back surface (side) conveyance path 42 and then the full-color toner image is transferable onto also the back surface of the recording material P.

Further, the recording material P discharged by the discharging roller 17 of the color image forming apparatus 101 can be guided onto a discharge tray 39 without being subjected to the transparent toner image transfer and heating by the fixing device 35.

Incidentally, with respect to an electrophotographic copying machine or printer, not only those for white/black (monochromatic) image formation but also those for full-color image formation are commercialized in many cases. Further, with the use of the copying machine or printer in various fields, needs to image quality are increased more and more.

As one of factors for improving the image quality, impartment of gloss representation is required. In order to meet the needs of the gloss representation, the image forming system 100 can execute the following types of the gloss representation by using the transparent image obtained by fixing the transparent toner image.

(1) A low-gloss portion and a high-gloss portion are copresent on the surface of an output product.

(2) The whole image surface of the output product is uniformly finished in the high-gloss portion, a medium-gloss portion and the low-gloss portion.

(3) The image constituting character information is lowered in glossiness to be made legible.

(4) A gradation image such as a photographic image or an illustrational image is increased in glossiness to improve its appearance.

(5) The high-gloss portion is partly formed in the gradation image to provide an emphasized representation.

(6) Depending on the uses of the output product, the whole image is represented with the low glossiness in a subdued manner or represented with the high glossiness in a photographic manner.

(7) A hidden character or a hidden mark is formed on the recording material with the transparent image.

(8) The transparent image is formed on the surface of the recording material so as to flatten the whole image by eliminating a difference in height among the respective color toner images.

<Image Forming Portion>

In the color image forming apparatus 101 which is an example of a first image forming apparatus in the image forming system 100, first toner images are formed on the photosensitive drums 1Y, 1M, 1C and 1K which are an example of a first image bearing member. In the transparent image forming apparatus 102 which is an example of a second image forming apparatus in the image forming system 100, a second toner image is formed on the photosensitive drum 1T which is an example of a second image bearing member.

The image forming portions PY, PM, PC and PK of the color image forming apparatus 101 and the image forming portion PT of the transparent image forming apparatus 102 basically have the same constitution except that the colors of the toners used in the respective developing devices are different from each other. Therefore, in the following, the image forming portion PT of the transparent image forming apparatus 102 will be described. With respect to the description on the image forming portions PY, PM, PC and PK of the color image forming apparatus 101, the suffix T added to constituent members of the image forming portion PT should be replaced with Y, M, C and K, respectively, and the intermediary transfer belt 46 should be replaced with the intermediary transfer belt 26.

The image forming portion PT includes, around the photosensitive drum 1T, a charging roller 2T, an exposure device 3T, a developing device 4T, a primary transfer roller 5T and a drum cleaning device 6T. The photosensitive drum 1T is prepared by forming a photosensitive layer having negative chargeability on an outer peripheral surface of an aluminum cylinder and is rotated in an arrow R1 direction at a predetermined process speed. The charging roller 2T electrically charges the surface of the photosensitive drum 1T to a uniform negative potential. The exposure device 3T exposes the charged surface of the photosensitive drum 1T to a laser beam by scanning through a rotating mirror, thus writing (forming) an electrostatic image for an image on the surface of the photosensitive drum 1T. The developing device 4T develops the electrostatic image on the photosensitive drum 1T with a two-component developer containing a transparent toner and a carrier in mixture.

The intermediary transfer belt 46 is extended around a driving roller 47*a*, a secondary transfer opposite roller 47*b* and a tension roller 47*c* and is rotated in an arrow R2 direction at a rotational speed of 130 mm/sec by being driven by the driving roller 47*a*. The tension roller 47*c* applies a predetermined tension to the intermediary transfer belt 46.

The primary transfer roller 5T urges an inner surface of the intermediary transfer belt 46 to form the primary transfer portion T1 between the photosensitive drum 1T and the intermediary transfer belt 46. By applying a DC voltage of the positive polarity to the primary transfer roller 5, the toner image of the negative polarity carried on the photosensitive drum 1T is primary-transferred onto the intermediary transfer belt 46.

A secondary transfer roller 49 is contacted to an outer surface of the intermediary transfer belt 46 supported by the secondary transfer opposite roller 47*b* to form the secondary transfer portion T2 between itself and the intermediary transfer belt 46. The secondary transfer opposite roller 47C is connected to the ground potential. A power source D49 applies the DC voltage of the positive polarity as a transfer voltage to the secondary transfer roller 49. As a result, the transparent toner image is secondary-transferred from the intermediary transfer belt 46 onto the recording material P.

The drum cleaning device 6T collects untransferred toner remaining on the photosensitive drum 1T without being transferred onto the intermediary transfer belt 46. A belt cleaning device 48 collects untransferred toner remaining on the intermediary transfer belt 46 without being transferred onto the recording material P.

<Developing Device>

Figure 2:
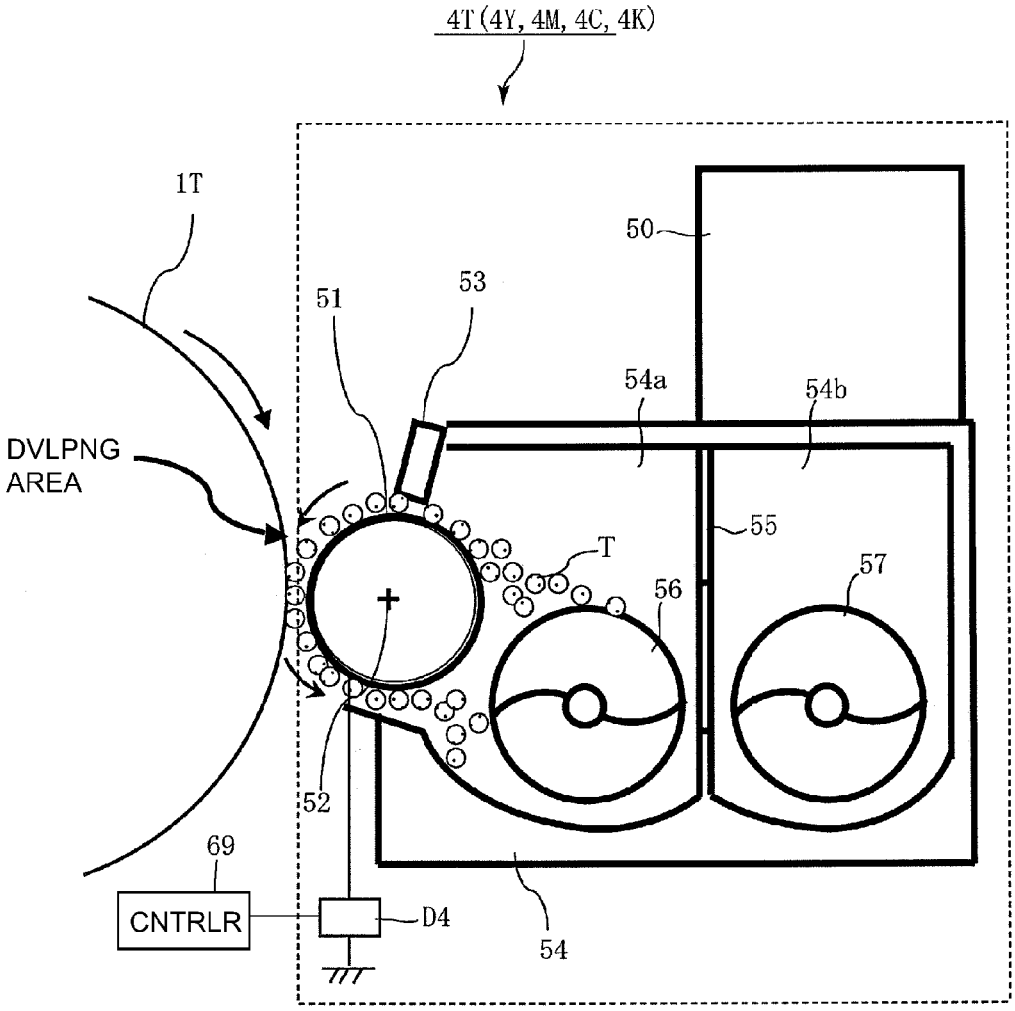
FIG. 2 is an illustration of a structure of a developing device.

FIG. 2 is an illustration of a structure of the developing device. As shown in FIG. 2, the developing device 4T reversely develops the electrostatic image on the photosensitive drum 1T with the two-component developer containing a non-magnetic transparent toner and a magnetic carrier, thus forming the transparent toner image.

The developing device 4T includes a developing container 54 accommodating the two-component developer. Above the developing container 54, a developer supplying portion 50 accommodating a toner for supply is provided. From the developer supplying portion 50, the toner in an amount corresponding to that of the toner consumed by the development is supplied in an uncharged state to the developing container 54. A toner content (T/D ratio) is defined as a weight ratio of the toner to the two-component developer. In order to stabilize the image quality, control is effected so that a change in toner content (T/D ratio) in the developer during the operation is detected and then on the basis of a detection result of the toner content, toner supply timing is determined.

At an opening of the developing container 54 facing the photosensitive drum 1T, a developing sleeve 51 which is an example of a developer carrying member is rotatably provided. Inside the developing sleeve 51, a magnet roller 52 for magnetically carrying the developer at the surface of the developing sleeve 51 is fixedly provided in a non-rotational state against the rotation of the developing sleeve 51.

Inside the developing container 54, a developing chamber 54*a* and a stirring chamber 54*b* which are partitioned by a partition wall 55 provided with openings at longitudinal end portions are provided. A developing screw 56 is provided in the developing chamber 54*a* and a developing screw 57 is provided in the stirring chamber 54*b*. The developing screws 56 and 57 feed the developer in longitudinal opposite directions while stirring the developer to circulate the developer in the developing container 54. By this stirring mixing, the toner and the carrier in the developer are triboelectrically charged to the negative polarity and the positive polarity, respectively, thus being attracted to each other.

Above the developing sleeve 51 of the developing container 54, a regulating blade 53 for regulating a layer thickness of the developer carried on the developing sleeve 51 by a magnetic force of the magnet roller 52 to form the developer layer in a small thickness is provided. The developer formed in the thin developer layer is, when being fed to a developing area in which the developer opposes the photosensitive drum 1T, erected to form a chain by the magnetic force of a main developing pole of the magnet roller 52 located in the developing area, so that a magnetic brush of the developer is formed. The magnetic brush of the developer slides on the surface of the photosensitive drum 1T and to the developing sleeve 51, a developing voltage in the form of the DC voltage biased with an AC voltage is applied from a power source D4. As a result, the toner deposited on the carrier constituting the chain of the magnetic brush is transferred onto an exposed portion of the photosensitive drum 1T which is positive relative to the developing sleeve 51, so that the electrostatic image is reversely developed into the transparent toner image on the photosensitive drum 1T.

In the two-component developer, as desired, a parting agent such as a wax and an external additive such as silica are contained. Incidentally, with respect to the image forming portions TY, TH, TC and TK, it is also possible to select a one-component developer consisting only of the magnetic toner.

A glass transition temperature (Tg) of a binder resin used for the transparent toner may preferably be 40-70° C., more preferably be 45-65° C. The binder resin used for the transparent toner may be a polymer alone. Alternatively, it is also possible to appropriately mix two or more species of polymers so as to provide a theoretical glass transition temperature (Tg) of 40-70° C. described in "Polymer handbook, Second Edition III (John Whiley & Sons Inc.), pp. 139-192".

The toner may include colored resin particles containing the binder resin, a colorant and other optional additives and include colored particles to which an external additive such as colloidal silica fine powder is added. The transparent toner contains no colored resin particles or a slight amount of the colored resin particles in order to ensure transparency. The color image forming apparatus uses the color toners Y, M, C and K and the transparent image forming apparatus uses the transparent toner. The transparent toner contains the same component as those of the color toners except that the coloring pigment is not added. For both of the color toners and the transparent toner, the binder resin having the glass transition temperature Tg of 55° C. was used.

As the binder resin, a polyester-based resin material can be suitably used. A volume-average particle size of the toner may preferably be 5 μm or more and 8 μm or less. In this embodiment, the toner having the volume-average particle size of 7.0 μm was used. The external additive is colloidal silica fine powder, and the amount of the external additive is adjusted so as to provide the toner charge amount of 25 μC/g in an environment of 23° C./50% RH.

As the carrier, e.g., surface-oxidized or unoxidized metal such as iron, nickel, cobalt, manganese, chromium or rare earth metal, and their alloys or oxides, or ferrite may suitably be usable. A manufacturing method of these magnetic particles is not particularly limited. The volume-average particle size of the carrier may preferably be 20-50 μm, more preferably 30-40 μm. Further, a volume resistance of the carrier may preferably be $10^7$ Ωcm or more and $10^{12}$ Ωcm or less, more preferably be $10^8$ Ωcm or less. In this embodiment, the carrier of 35 μm in volume-average particle size, $5\times10^8$ Ωcm in volume resistivity and 200 emu/cc in intensity of magnetization was used.

In order to meet image quality improvement and speed-up, the carrier hang the intensity of magnetization lower than that of a conventional carrier is used. When the carrier having the lower intensity of magnetization is used, the toner is less damaged and a preferable image quality is obtained, while a probability of the transfer of the carrier from the developing sleeve 51 onto the photosensitive drum 1T is somewhat increased by the development.

In the case where the two-component developer is prepared by mixing the carrier and the toner, the toner content may be 1-15%, more preferably be 3-12%, further preferably be 5-10% for obtaining a letter result. This is because the image density is lowered at the toner content of less than 1% and a degree of fog or scattering in the apparatus is increased to result in a lowering in durable lifetime at the toner content of more than 15%. In this embodiment, the toner content was 8%.

Incidentally, the toner used in the developing device 4T is not limited to the transparent toner. The color of the toner to be superposedly transferred onto the fixed image may also be, e.g., R (red), G (green), B (blue) and other intermediate colors. These colors may be transparent or opaque.

<Fixing Device>

Figure 3:
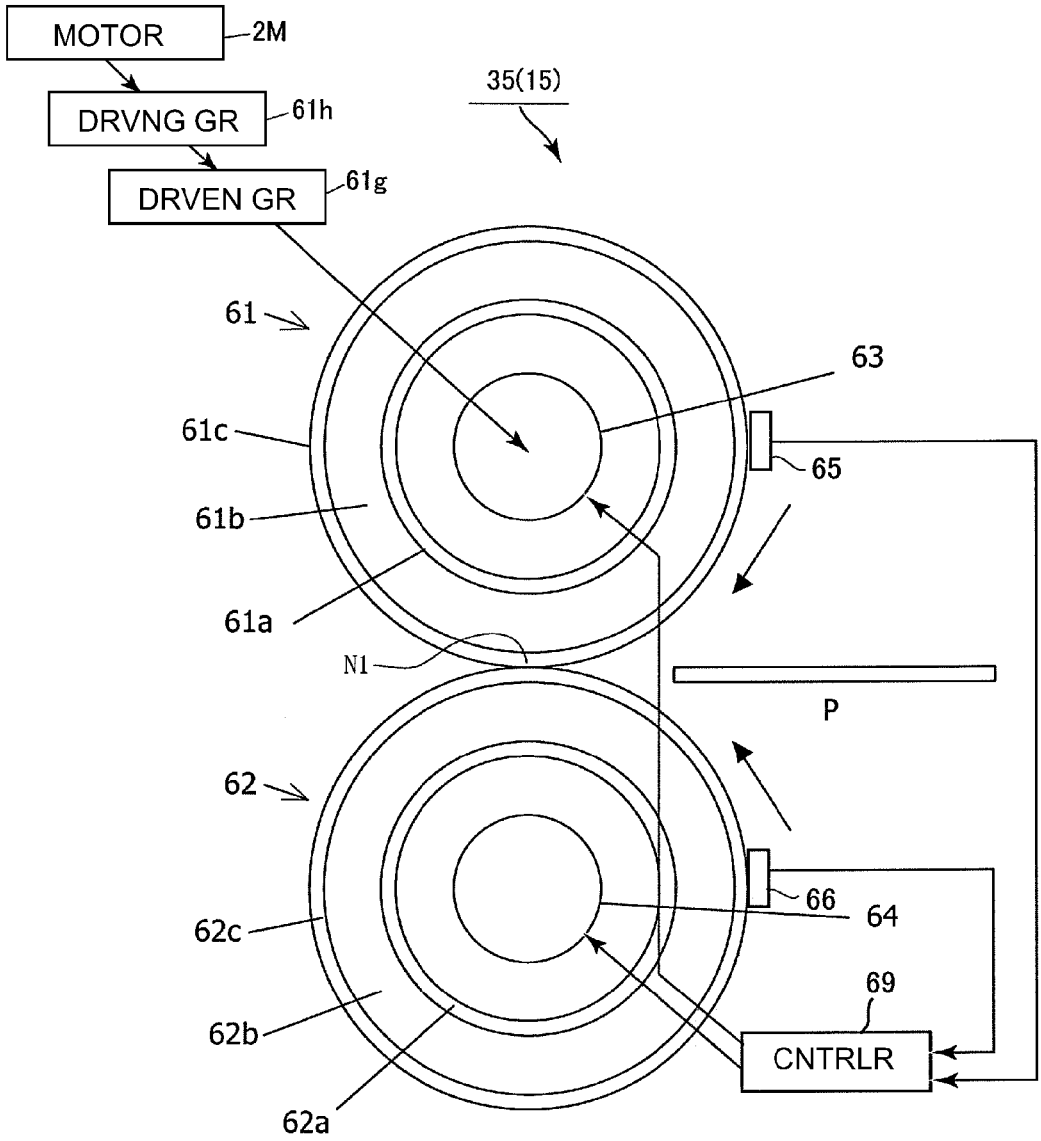
FIG. 3 is an illustration of a structure of a fixing device.

FIG. 3 is an illustration of a structure of the fixing device. Parts (a) and (b) of FIG. 4 are illustrations of behavior of the toner before and after the fixing, respectively, when carrier deposition occurs.

As shown in FIG. 1, the fixing device 15 which is an example of an image heating device heats and presses the recording material P on which the full-color toner image is transferred at the secondary transfer portion T2, and fixes the full-color toner image on the recording material P. The fixing device 35 heats and presses the recording material P on which the transparent toner image is transferred at the secondary transfer portion T2, and fixes the transparent toner image on the recording material P. The fixing devices 15 and 35 are constituted and controlled identically to each other and therefore in the following the fixing device 35 will be described and the fixing device 15 is omitted from redundant description.

As shown in FIG. 3, the fixing device 35 (15) includes a fixing roller 61 as a rotatable fixing member and a pressing roller 62 as a rotatable pressing member. The pressing roller 62 is press-contacted to the fixing roller 61 to form a fixing nip N1 for the recording material P. Pressure in the fixing nip N between the fixing roller 61 and the pressing roller 62 is set at about 490 N (50 kgf) as a total pressure.

The fixing roller 61 is constituted as a lamination structure prepared by forming, on an outer peripheral surface of a hollow core metal 61*a* of aluminum (Al), iron (Fe) or the like, a roller-like rubber layer 61*b* as an elastic layer and forming, on the outer peripheral surface of the rubber layer 61*b*, a fluorine-containing resin layer 61*c* as a parting layer. Inside the hollow core metal 61*a*, a halogen heater 63 as a heat source is provided.

In the neighborhood of the surface of the fixing roller 61, a thermistor 65 as a temperature detecting means for detecting the surface temperature is provided. Turning on/off of energization to the halogen heater 63 provided inside the fixing roller 61 is controlled by a controller 69 on the basis of an output signal from the thermistor 65. A fixing temperature (target temperature) of the fixing roller 61 is set at 180° C. and is controlled by the controller (control device) 69 so as to be kept at the fixing temperature.

A driven gear 61*g* is provided at an end portion of the hollow core metal 61*a* of the fixing roller 61. The driven gear 61*g* is driven by a driving gear 61*h* provided on an output shaft of an image formation motor 2M. As a result, the fixing roller 61 is rotated at the process speed of 130 mm/sec. Then, a rotational force of the fixing roller 61 is transmitted to the surface of the pressing roller 62 via the fixing nip N1, so that the pressing roller 62 is rotated by the rotation of the frequency 61.

The pressing roller 62 is constituted as a lamination structure prepared, similarly as in the case of the fixing roller 61, by forming, on an outer peripheral surface of a hollow core metal 61*a*, a roller-like rubber layer 62*b* as an elastic layer and forming, on the outer peripheral surface of the rubber layer 62*b*, a fluorine-containing resin layer 62*c* as a parting layer. Inside the hollow core metal 62*a*, a halogen heater 64 as a heat source is provided.

In the neighborhood of the surface of the pressing roller 62, a thermistor 66 as a temperature detecting means for detecting the surface temperature is provided. Turning on/off of energization to the halogen heater 64 provided inside the pressing roller 61 is controlled by the controller 69 on the basis of an output signal from the thermistor 66. A fixing temperature (target temperature) of the pressing roller 62 is set at 150° C. and is controlled by the controller (control device) 69 so as to be kept at the fixing temperature.

Incidentally, the fixing device 35 is not limited to a roller pair of the fixing roller 61 and the pressing roller 62 but may also be constituted so that at least one of the fixing roller 61 and the pressing roller 62 is replaced with an endless belt member. Further, the heat source for the fixing roller 61 and the pressing roller 62 is not limited to the halogen heater but may also be a heater of an IH type using electromagnetic induction heating.

The temperature of the recording material P sent from the fixing nip N1, i.e., a recording material separating temperature at which the recording material P is started to be separated from the surface of the fixing roller 61 is kept at a high temperature of, e.g., about 90-110° C. That is, a recording material separating method by the fixing device 35 is a high-temperature separation type in which the recording material P is, after completely passing through the fixing nip N1, started to be separated from the fixing device 35 while being kept at the high temperature.

Incidentally, as shown in FIG. 1, in the image forming system 100, the image formation on one sheet is effected in such a manner that the transfer and fixing operation is divided in two operations including the operation for the color toner image and the operation for the transparent toner image. In this case, compared with the case where the image formation is effected in such a manner that a single transfer and fixing operation is performed for the color toner images and the transparent toner image, the influence of the carrier deposition on the surface of a final image is liable become conspicuous.

Further, in the developing device 4T of the transparent image forming apparatus, compared with the developing devices 4Y to 4K, the carrier having the low intensity of magnetization is used. Therefore, compared with the case where the carrier having the high intensity of magnetization is used similarly as in the case of the developing devices 4Y to 4K, the carrier is liable to be transferred onto the photosensitive drum 1T during the development.

As shown in FIG. 4 with reference to FIG. 3, when the transparent toner image on which the carrier deposition occurs during the transfer reaches the fixing device 35, in the fixing nip N1, a difference in height of the image occurs due to the difference in particle size between the carrier and the toner. Further, due to the height difference, a contact state with the fixing roller 61 varies. At a carrier deposition portion, the particle size (40 μm) of the carrier is larger than that (5 μm) of the toner, so that the projection is formed on the image. As a result, as shown in (b) of FIG. 4, in the fixing nip N1, improper contact with the fixing roller 61 occurs around the carrier deposition portion occurs, so that partly improper fixing is caused. Therefore, the glossiness in the neighborhood of the carrier deposition portion differs from that around the carrier deposition portion, so that minute uneven glossiness occurs.

As shown in (a) of FIG. 4, the uneven glossiness at the carrier deposition portion also occurs with respect to the color image forming apparatus 101 but is further conspicuous in the case where the transparent toner image is transferred and fixed on the fixed image, which is characteristic to the transparent image forming apparatus 102.

In the case where the transparent toner image is directly formed on the recording material, the deposited carrier is fixed while being pressed against the recording material surface to cause the partly improper fixing in the neighborhood of the carrier, so that the uneven glossiness is caused. At this time, in the case where the surface of the recording material is soft and rough, the carrier is buried in the recording material surface, so that a range of the occurrence of the uneven glossiness is narrowed. When the recording material such as plain paper is used, the carrier is liable to be buried in the recording material surface. When the recording material having a coating layer is used, the carrier is less liable to be buried in the recording material surface compared with the case of the plain paper but is not so buried as in the case of the fixed image.

On the other hand, in the case where the transparent toner image is transferred and fixed on the fixed image, the deposited carrier is fixed while being pressed against the fixed image surface which has rigidity much higher than that of the recording material so that the partly improper fixing occurs in the neighborhood of the carrier to cause the uneven glossiness. On the fixed image, the carrier is not buried in the surface of the fixed image and therefore the occurrence range of the uneven glossiness is enlarged. In addition, minute cracking occurs in the background fixed image by the pressing by the carrier when the recording material passes through the fixing nip N1, so that the uneven glossiness is emphasized. For this reason, even in the case where any type of the recording material is used, when the transparent toner image is transferred and fixed on the fixed image, a degree of minute uneven glossiness due to the carrier deposition becomes more conspicuous them in the case where the transparent toner image is transferred and fixed on the recording material.

For this reason, in order to suppress the lowering in image quality by the carrier deposition, there is a need to reduce the amount of the carrier deposition itself. However, the developing condition is set so as to ensure a transfer efficiency and gradation representation property at high level while permitting the carrier deposition to some extent and therefore when the developing condition is changed so as to reduce the amount of the carrier deposition, the lowerings in developing property and reproducibility can occur.

In the following embodiments, the developing condition such that the amount of the carrier deposition is not selected in the case where the carrier deposition is not conspicuous but is selected only in the case where the transparent toner image is transferred and fixed on the fixed image.

Embodiment 1

FIG. 5 is an illustration of respective portion potentials during the development. Parts (a) and (b) of FIG. 6 are illustrations of two types of the AC voltages. FIG. 7 is a graph for illustrating a developing property of the two types of the AC voltages. FIG. 8 is a graph showing a relationship between the toner amount per unit area and glossiness of the transparent toner image.

As shown in FIG. 1, the transparent image forming apparatus 102 is capable of executing an operation in a first image forming mode in which the toner image is transferred onto the fixed image of another toner image and an operation in a second image forming mode in which the toner image is transferred onto the recording material surface.

On the photosensitive drum 1T, the transparent toner image using the transparent toner is formed. In the operation in the first image forming mode, the transparent toner image is superposedly transferred onto the full-color image on the recording material on which the fixed image of the full-color image is formed. In the operation in the second image forming mode, the transparent toner image is transferred on the recording material surface which is not covered with the full-color image. That is, the second image forming mode is such that the transparent toner is placed on the recording material surface on which the toner is not placed. For example, the second image forming mode is selected in the case where the transparent toner image is formed on the recording material surface on which an ink jet image is formed or on the recording material surface on which the toner image is not formed. In the image forming system as shown in FIG. 1, the image forming operation with the transparent toner is effected in the downstream-side image forming apparatus without effecting the image forming operation with the color toner images in the upstream side image forming apparatus is performed in the second image forming mode.

As shown in FIG. 2, the developing device 4T carries the magnetic brush of the developer containing the toner and the carrier on the developing sleeve 51 which is an example of the developer carrying member, and develops the electrostatic image on the photosensitive drum 1T, which is an example of the image bearing member, into the toner image. The power source D4 applies to the developing sleeve 51 the developing voltage in the form of the DC voltage biased with the AC voltage.

As shown in FIG. 3, the fixing device 35 heats and presses the recording material, on which the toner image is transferred, to fix the toner image on the recording material.

As shown in FIG. 2, the controller 69 which is an example of the control means controls the developing device 4T so that the developing condition in which the probability that the carrier is transferred from the developing sleeve 51 onto the photosensitive drum T1 in the operation in the first image forming mode is lower than that in the operation in the second image forming mode. In other words, in the operation in the first image forming mode, the developing condition in which the transfer of the carrier from the developing device 4T onto the image bearing member is more suppressed than in the operation in the second image forming mode is employed. In the operation in the first image forming mode, at least one of the DC voltage and the AC voltage is made different from that in the operation in the second image forming mode so that the probability that the carrier is transferred from the developing sleeve 51 onto the photosensitive drum 1T is lower than that in the operation in the second image forming mode. In the operation in the first image forming mode, the number of pulses of the AC pulse which is intermittently thinned from the blank pulse waveform every predetermined period is reduced.

As shown in FIG. 5 with reference to FIG. 2, on the photosensitive drum 1T, a non-image portion charged to the dark portion potential VD (−550 V) and an exposed portion exposed and lowered in potential to the light portion potential VL (−150 V) are formed. When the developing voltage in the form of the DC voltage Vdc biased with the AC voltage Vac is applied to the developing sleeve 51, at the exposed portion, the toner in quantity of electricity cancelling a developing contrast Vcont which is the potential difference between the DC voltage Vdc and the light portion potential VL is used for the development.

In this embodiment, the AC voltage applied to the developing sleeve 51 of the developing device 4T is switched between the operation in the first image forming mode in which the transparent toner image is transferred and fixed on the fixed image and the operation in the second image forming mode in which the transparent toner image is transferred and fixed on the recording material. In an operation in a 5-color mode in which the fixed image is formed with the four color toners on the recording material fed from the first recording material cassette 10 in the color image forming apparatus 101 and then the transparent toner image is superposed on the fixed image in the transparent image forming apparatus 102, as shown in (b) of FIG. 6, the AC voltage is rectangular wave. On the other hand, in an operation only in a transparent mode in which the transparent toner image is formed on the recording material fed from the second recording material cassette 30 in the transparent image forming apparatus 102, as shown in (a) of FIG. 6, the AC voltage is a double blank pulse.

(1) AC Voltage when Recording Material is Fed from First Recording Material Cassette Frequency: 12 kHz Vpp voltage: 2.0 KV Waveform: rectangular wave (2) AC Voltage when Recording Material is Fed from Second Recording Material Cassette Frequency: 12 kHz Vpp voltage: 2.0 KV Waveform: double blank pulse rectangular wave AC pulse number: 2 pulses/8 pulses Blank pulse number: 6 pulses/8 pulses Image formation was effected by performing the operation in the first image forming mode using the AC voltage (1) and the operation in the second image forming mode using the AC voltage (2). Each of output images were evaluated with respect to a carrier deposition level, uneven glossiness and glossiness fluctuation. As the recording material, "OK Top-Coated Paper (157 gsm)" (trade name) manufactured by Oji Paper Co., Ltd. was used for the evaluation. The carrier deposition level was evaluated as the number of the carrier observed in an area of 50 mm×50 mm on the fixed image surface.

TABLE 1

| Cassette | Bias*1 | Level*2 | UG*3 | GF*4 |
|---|---|---|---|---|
| 1 | RECT | 1 | ○ | Δ |
| 2 | WBP | 6 | ○ | ◎ |

*1"Bias" refers to a set bias. "RECT" is the rectangular wave, and "WBP" is the double blank pulse bias.

*2"Level" refers to the carrier deposition level.

*3"UG" refers to the uneven glossiness (image property). "○" represents that the uneven glossiness is not conspicuous.

*4"GF" refers to the glossiness fluctuation. "Δ" represents that the glossiness fluctuation is small. "◎" represents that there is substantially no glossiness fluctuation.

The image formation was effected by performing the operations in the first image forming mode and the second image forming mode both using the AC voltage (2). Each of output images was evaluated with respect to the carrier deposition level, the uneven glossiness and the glossiness fluctuation in the same manner as described above.

TABLE 2

| Cassette | Bias*1 | Level*2 | UG*3 | GF*4 |
|---|---|---|---|---|
| 1 | WBP | 6 | X | ◎ |
| 2 | WBP | 6 | ○ | ◎ |

*1"Bias" refers to a set bias. "WBP" is the double blank pulse bias.

*2"Level" refers to the carrier deposition level.

*3"UG" refers to the uneven glossiness (image property). "○" represents that the uneven glossiness is not conspicuous. "X" represents that the uneven glossiness is conspicuous.

*4"GF" refers to the glossiness fluctuation. "◎" represents that there is substantially no glossiness fluctuation.

As shown in Table 1, when the rectangular wave was used as the AC voltage, the carrier deposition level was lowered from the level 6 (Table 2) to the level 1 (Table 1), so that the uneven glossiness became inconspicuous. The glossiness fluctuation for each image was somewhat increased but the quality of the output image on one sheet was considerably enhanced. In the operation in the image forming mode, the transparent toner image is transferred and fixed on the fixed image and therefore the carrier deposition is conspicuous. For this reason, by using the rectangular wave as the AC voltage, the amount of the carrier deposition is reduced.

As shown in FIG. 7, the rectangular wave (pulse) has a larger sensitivity of a halftone image density with respect to the developing contract (potential difference between the light portion potential and the DC voltage), so that the image density fluctuation is relatively large with respect to the light portion potential fluctuation. For this reason, from the viewpoint of halftone reproducibility, i.e., from the viewpoint that a small fluctuation in image density with respect to the developing contrast fluctuation is preferred, the double blank pulse has the upper hand. Therefore, in the operation in the second image forming mode, the transparent toner image is transferred and fixed on the recording material, so that the carrier deposition is inconspicuous and therefore the halftone reproducibility is ensured by using the double blank pulse as the AC voltage.

On the other hand, as shown in Table 2, when the AC voltage is set at (2) in the operation in the second image forming mode, even at the same carrier deposition level of 6, the uneven glossiness becomes conspicuous. The glossiness fluctuation for each image is small but the quality of the output image on one sheet is impaired. In the case where the transparent toner image is formed on the color toner image fixed on the recording material fed from the first recording material cassette 10, the uneven glossiness due to the carrier deposition is very conspicuous and therefore the image quality is lowered.

As shown in FIG. 8, when the toner amount per unit area of the transparent toner (the transparent toner weight per unit area) is increased, the glossiness (gloss) of the output image is enhanced. The glossiness was measured by a glossimeter ("PG-3D", mfd. by Nippon Denshoku Industries Co., Ltd.) at a gloss measuring angle of 60 degrees, and the measured value was taken as a fixing glossiness. The relationship between the toner amount and the glossiness of the transparent toner image is in the direction in which a degree of the lowering in glossiness due to the unevenness of the recording material is decreased, thus showing an upward-sloping curve in the range shown in FIG. 8. Specifically, in the range of the toner amount from 0.15 mg/cm$^2$ to 0.25 mg/cm$^2$ in which a color fluctuation of the color toner is most visually noticeable, the glossiness fluctuation per toner amount of 0.1 mg/cm$^2$ is 7.

Here, in view of the fact that the substantially uniform glossiness can be recognized when the glossiness fluctuation is less than 5, a tolerable range of the toner amount fluctuation is within about 0.05 mg/cm$^2$. Therefore, in the case where it is assumed that the uneven glossiness due to the carrier deposition is less, it is desirable that the halftone reproducibility is increased by suppressing the glossiness fluctuation due to the toner amount fluctuation.

Control in Embodiment 1

FIG. 9 is a block diagram of a control system of the image forming system. FIG. 10 is an illustration of a mode selecting screen on an operating panel. FIG. 11 is a flow chart of the control in Embodiment 1.

The image forming system 100 shown in FIG. 1 is capable of executing the operations in a 4-color image forming mode, the 5-color image forming mode and a particular-color image forming apparatus. In the operation in the 4-color image forming mode, the color image is printed on the recording material with the four color toners. In the operation in the 5-color image forming mode, the transparent toner image is superposedly printed with the transparent toner on the color image printed or the recording material. In the particular-color image forming mode, only the transparent toner image is printed on the recording material with the transparent toner.

As shown in FIG. 9, these image forming modes are stored in a memory of the controller 69 as a control sequence. The controller 69 displays the mode selecting screen of these image forming modes on a display 71 of the operating portion 70. When a user operates the operating portion 70, as shown in FIG. 10, the mode selecting screen is displayed on the display 71. When the user selects a desired image forming mode, the color image forming apparatus 101 executes the operation in the selected image forming mode in association with the transparent image forming apparatus 102.

The color image forming apparatus 101 includes a storing device 72 such as HDD in its main assembly. In the storing device 72, a data file transferred from an external device such as a host computer and image data read by an image reading device 103 can be temporarily stored. The user displays the data stored in the storing device 72 on the display 71 of the operating portion 70 as desired and selects the image forming mode. Specifically, the user displays any of the data sent from the external device, the data read by the image reading device and the data stored in the storing device on the display 71 and selects the image forming mode.

As shown in FIG. 11, the controller 69 obtains information on the recording material cassette from which the recording material is fed (S101).

The controller 69 judges whether a print signal of the obtained information on the recording material cassette is the print signal of the "first recording material cassette 10" or the "second recording material cassette 30" (S102). When the print signal is that of the "first recording material cassette 10", the controller 69 operates the pick-up roller 12, the separating roller 13 and the registration roller 14 in order to execute the operation in the first image forming mode (S103).

The controller 69 effects the 4 color-based color image printing on the recording material by the color image forming apparatus 101 (S104). The respective color toner images formed at the image forming portions PY, PM, PC and PK are transferred onto the intermediary transfer belt 26. The full-color toner image obtained by superposing the respective color toner images is secondary-transferred from the intermediary transfer belt 26 onto the recording material P and then is conveyed into the fixing device 15. The fixing device 15 heat-fixes the unfixed full-color toner image on the recording material P (S105).

The controller 69 judges that the print signal is that for the "4-color mode" or the "5-color mode" (S106). When the print signal is that for the "4-color mode", the recording material P on which the color image is formed is discharged onto the discharge tray 39 via the non-image formation conveying portion 43 (S107).

When the print signal is that for the "5-color mode", the superposing printing with the transparent toner is to be effected on the color image on the recording material P, so that the transparent toner image is formed on the photosensitive drum 1T (S108). In this case, the developing device 4T develops the electrostatic image on the photosensitive drum 1T by using the rectangular wave AC voltage to prioritize the suppression of the carrier deposition. The transparent toner image formed on the photosensitive drum 1T is primary-transferred onto the intermediary transfer belt 46 and then is conveyed to the secondary transfer portion T2. The recording material P on which the color image is formed in the color image forming apparatus 101 is sent to the secondary transfer portion T2, and the transparent toner image is transferred onto the whole surface of the recording material P.

The recording material P coming out of the secondary transfer portion T2 is introduced into the fixing nip N1 of the fixing device 35 to be subjected to heat and nip pressure. The unfixed transparent toner image is melted and heat-fixed on the recording material P (S109). The recording material P on which the transparent image is formed on the color image is discharged onto the discharge tray 38 of the transparent image forming apparatus 102 (S110).

The controller 69 operates, when the print signal is that for the "second recording material cassette", the pick-up roller 32, the separating roller 33 and the registration roller 34 in order to execute the operation in the second image forming mode (S111).

The controller 69 forms the transparent toner image on the photosensitive drum 1T and primary-transfers the transparent toner image onto the intermediary transfer belt 46 (S112). At this time, the AC voltage for the developing voltage is the double blank pulse. The transparent toner image is secondary-transferred onto the recording material P which is fed from the second recording material cassette 30 and on which the fixed image is not formed. The recording material P on which the transparent toner image is secondary-transferred is introduced into the fixing nip N1 of the fixing device 35, and the transparent toner image is heat-fixed on the recording material P (S113). The recording material P on which the transparent toner image is fixed is discharged on the discharge tray 38 of the transparent image forming apparatus 102 (S114).

In this embodiment, only in the case where the transparent toner image is transferred and fixed on the color image fixed on the recording material P fed from the first recording material cassette 10, the rectangular wave is used as the AC voltage, so that the frequency of the carrier deposition is decreased and the improvement in image quality is achieved.

As described above, it became possible to reproduce the good gradation property with the transparent toner on the recording material P while suppressing the occurrence of the image portion carrier deposition when the transparent image is formed on the fixed color image. As a result, it became possible to provide the high-quality output image with uniform glossiness.

<Relationship Between AC Voltage and Carrier Deposition>

FIG. 12 is an illustration of carrier deposition. Parts (a) and (b) of FIG. 13 are illustrations of charge injection into a carrier. FIG. 14 is a graph showing a relationship between an AC voltage waveform and an amount of carrier deposition. FIG. 15 is an illustration of a double blank pulse. FIG. 16 is a graph showing a relationship between the number of blank pulses and a carrier deposition level.

As shown in FIG. 5, on the photosensitive drum 1T, the non-image portion with the dark portion potential VD and the exposed portion with the light portion potential VL (−150 V) are formed, and the developing voltage in the form of the DC voltage Vdc biased with the AC voltage Vac is applied to the developing sleeve 51.

The potential difference between the DC voltage Vdc and the light portion potential VL is the developing contrast Vcont. As shown in FIG. 12, when the magnetic chain of the carrier m formed on the developing sleeve 51 slides on the photosensitive drum 1T, the toner n electrostatically constrained by the carrier m is transferred onto the photosensitive drum 1T by being driven by the developing contrast Vcont.

The potential difference between the DC voltage Vdc and the dark portion potential VD is a fog removing contrast Vback. The fog removing contrast Vback pushes back the toner from the non-exposed portion of the photosensitive drum 1T to the developing sleeve 51, so that a white background fog by which the toner is deposited on the non-image portion is prevented.

Therefore, the carrier charged to the positive polarity opposite to the toner charge polarity is electrostatically urged against the non-image portion of the photosensitive drum 1T by the fog removing contrast Vback, so that the carrier is deposited on the non-image portion. This phenomenon occurs conspicuously in the case where the fog removing contrast Vcont is excessive.

As shown in FIG. 12, the end carrier m of the magnetic chain sliding on the photosensitive drum 1T through the toner forms a type of capacitor between itself and the photosensitive drum 1T. Further, the developing sleeve 51 is biased to the negative potential relative to the exposed portion of the photosensitive drum 1T and therefore the negative electric charge is injected into the magnetic chain end carrier m. Then, by the injected electric charge, when the charging state of the magnetic chain end carrier m is reversed to the negative charging state, the magnetic chain end carrier m is electrostatically deposited on the exposed portion which is positive in charge polarity relative to the developing sleeve 51. This phenomenon occurs conspicuously during a high density development in which the developing contrast Vcont is large.

Thus, there are two types with respect to the phenomenon that the carrier is transferred from the developing sleeve 51 during the development and is deposited on the photosensitive drum 1T. First carrier deposition is non-image portion carrier deposition by which the carrier is deposited on the non-image portion of the electrostatic image. Second carrier deposition is image portion carrier deposition by which the carrier is deposited on the image portion of the electrostatic image.

Of these two types of the carrier deposition, the first carrier deposition occurs alone separately from the toner image, so that there is no influence on the toner image. On the other hand, the second carrier deposition causes, when the toner image is primary-transferred from the photosensitive drum 1T onto the intermediary transfer belt 46, a transfer voltage around the carrier which is larger in particle size than the toner to become insufficient, so that a transfer efficiency is lowered and the toner image becomes the transparent image from which the toner is dropped in a white dot-like shape.

Further, also in the case where the transfer is normally effected, in the fixing nip N1 of the fixing device 35, the fixing pressure is insufficient at a position around the carrier which is larger in particle size than the toner and therefore dot-like fixing non-uniformity. The carrier deposition portion constitutes a projection on the image surface and therefore contact failure between the image and the fixing roller 61 occurs around the carrier deposition portion. With the carrier deposition portion as the center, a gloss state is different from that around the carrier deposition portion in a dot-like shape to result in minute dot-like uneven glossiness, so that the apparent image quality of the output image is considerably impaired.

Further, in the transparent image forming apparatus 102, the transparent toner image is transferred and fixed on the fixed image and therefore, compared with the case where the transparent toner image is transferred and fixed on the unfixed image or on the recording material, the carrier is liable to be exposed from the surface of the transparent toner image. Thus, the dot-like range in which the uneven glossiness occurs is broadened and the underlying fixed image is partly dented, so that the dot-like range becomes more conspicuous.

As shown in (a) of FIG. 13, when an electric field with electric field intensity E in a direction in which the toner is carried toward the photosensitive drum 1T is formed, there is an increasing possibility that the magnetic chain end carrier m is forcedly charged to the negative polarity by accumulation of the negative electric charge due to a capacitor effect or contact resistance between the magnetic chain end carrier m and the photosensitive drum 1T.

When the negative electric charge Qc is accumulated on the magnetic chain end carrier m, a force Qc×E is exerted on the magnetic chain end carrier m toward the photosensitive drum 1T. On the other hand, toward the developing sleeve 51, a magnetic attraction force of the magnet roller 52 in the developing sleeve 51 or an attracting force generated by interaction between the carriers is exerted.

As shown in (b) of FIG. 13, in the case where the force Qc×E exceeds the attracting force, there is an increasing possibility that the magnetic chain end carrier m is transferred onto the photosensitive drum 1T to cause the image portion carrier deposition. With a higher electric field intensity between the developing sleeve 51 and the photosensitive drum 1T or a longer exposure time of the carrier to the electric field intensity E, the charging of the magnetic chain end carrier to the negative polarity is accelerated, so that there is an increasing possibility that the image portion carrier deposition occurs.

However, as shown in (a) of FIG. 13, when the electric discharge between the magnetic chain end carrier m and the photosensitive drum 1T is generated by applying a large negative voltage to the magnetic chain end carrier m, the negative electric charge is drastically removed from the magnetic chain end carrier m. In the case where the electric field intensity E is very large or in the case where the electric field intensity E is applied for a further long time, electric change transfer due to the electric discharge occurs toward the photosensitive drum 1T exceeding an electric discharge threshold.

As shown in (c) of FIG. 13, when the negative electric charge is removed by the electric discharge, the electric charge amount Qc is decreased correspondingly to the amount of the carrier moved to the photosensitive drum 1T, so that the force Qc×E is also decreased and the attracting force toward the photosensitive drum 1T becomes small. As a result, the image portion carrier deposition does not occur.

For this reason, as shown in FIG. 14 by a broken line, the image portion carrier deposition shows a complicated correlation with the product of the electric field between the developing sleeve 51 and the photosensitive drum 1T and a time in which the electric field is continuously applied. In FIG. 14, the abscissa represents the product of the electric field E between the developing sleeve 51 and the photosensitive drum 1T and the time T, i.e., E×T, and the ordinate represents the amounts of the charge transfer from the carrier onto the photosensitive drum 1T and the amount of the image portion carrier deposition.

When the abscissa, i.e., E×T is small (left side), the charge transfer from the magnetic chain end carrier m onto the photosensitive drum 1T is not readily effected and on the other hand, the electric charge is liable to be accumulated on the magnetic chain end carrier m, so that the image portion carrier deposition is liable to occur with an increase in E×T.

However, when E×T is increased to some extent (right side), the charge transfer from the magnetic chain end carrier m onto the photosensitive drum 1T due to the electric discharge is effected and the amount of electric charge accumulation on the magnetic chain end carrier m is decreased, so that the image portion carrier deposition does not readily occur.

Therefore, by changing at least one of the DC voltage and the AC voltage which constitute the developing voltage, it is possible to lower at least a probability that the image portion carrier deposition of the magnetic chain end carrier m occurs. In other words, the developing condition is changed to that in which the deposition of the carrier on the photosensitive drum is suppressed.

The occurrence probability of the image portion carrier deposition can be actually measured easily. Specifically, the image is actually formed by changing a parameter such as the DC voltage or the AC voltage, and then the number of occurrences of minute uneven glossiness appearing on the image in a unit area may be counted. By obtaining a relationship between the number of occurrences and the parameter, it is possible to estimate the amount of the image portion carrier deposition when the developing voltage is changed. By conducting such an experiment, it is possible to estimate that the magnetic chain end carrier m when the developing voltage is changed belongs to what area on the abscissa (E×T) in FIG. 14.

As shown in FIG. 15, in Embodiment 1, as the AC voltage in the operation in the second image forming mode, the double blank pulse was used. The developing voltage using the double blank pulse as the AC voltage is referred to as a double blank pulse bias (WBP bias).

With respect to the WBP bias, in the developing voltage, an AC bias portion in which the DC voltage and the AC pulse are superposedly applied and a blank bias portion in which only the DC voltage is applied are repeated at a constant period. In the AC bias portion, an AC pulse for moving the toner from the developing sleeve 51 toward the photosensitive drum 1T and an AC pulse for moving the toner in an opposite direction are repeatedly applied plural times to the developing sleeve 51. In the blank bias portion after the AC pulse (providing a large developing contrast Vcont) for moving the toner from the developing sleeve 51 toward the photosensitive drum 1T is applied, the DC voltage Vdc is applied to the developing sleeve 51 for a certain time.

After the DC voltage Vdc for moving the toner onto only the image area in the blank bias portion, in the neighborhood of the photosensitive drum 1T, the AC pulse for vibrating the toner is applied. For this reason, at the image portion, the T/D ratio of the developer is apparently increased, with the result that the toner can be sufficiently supplied uniformly to the halftone portion area and thus a smooth image with less conspicuous development non-uniformity.

In the WVP bias, the above behavior of the toner improves the developing property in the entire density area and therefore even in the case where the T/D ratio is chronically lowered at the latter part of the durable lifetime of the photosensitive drum 4T, the developing property can be maintained at a high level and thus the WBP bias effectively acts on the development non-uniformity. This leads to much latitude with respect to the toner content control, the SD gap, the developer coating amount, and the like.

In FIG. 15, when the potential difference for generating a force in a direction in which the toner on the developing sleeve 51 is moved toward the photosensitive drum 1T is V and an application time of the potential difference V is T, these values V and T during the pulse bias application are V1 and T1 and those during the blank bias application are V2 and T2.

Here, the electric field intensity E described with reference to FIG. 14 is obtained by dividing the potential difference V by the gap between the developing sleeve 51 and the photosensitive drum 1T (SD gap). For that reason, the abscissa E×T in FIG. 14 is proportional to the product of V and T, i.e., V×T.

As shown in FIG. 16, when the time of the blank pulse portion is shortened under the condition of Embodiment 1, i.e., when the number of the blank pulses is decreased, it is understood that the image portion carrier deposition is alleviated.

FIG. 16 is a plot of the image portion carrier deposition level when the time T2 of the blank pulse portion of the WVP bias used in Embodiment 1 is changed. The ordinate represents the image portion carrier deposition level which is set at 8 levels from level 1 (good) to level 8 (poor). The image portion carrier deposition level is determined by counting the number of carrier deposition in a square area (5 cm×5 cm) on the image with the maximum density (255/255). The abscissa represents that the blank pulse portion corresponds to what pulse when one period of the AC pulse is taken as one pulse.

As shown in FIG. 16, the phenomenon that the degree of the image portion carrier deposition is alleviated with a shorter blank pulse portion occurs under the condition of Embodiment 1 shown at the left side. With a smaller E×T and a smaller amount of electric charge accumulated on the magnetic chain end carrier m, in the area, the amount of the image portion carrier deposition is more decreased.

As shown in FIG. 7, compared with the case where the rectangular wave is used, the WBP bias shows a highlight halftone image density. This is because the toner is sufficiently used for development even in a highlight halftone image area in which the potential contrast is small. For that reason, in the case where the rectangular bias is used, the development non-uniformity is observed in the highlight halftone area, while in the case where the WBP bias is used, the image with inconspicuous development non-uniformity is obtained. FIG. 7 shows a γ curve in the case where the WBP bias and the rectangular bias corresponding to a bias obtained by eliminating the blank pulse portion from the WBP bias. The γ curve shows a relationship between the image density and the developing contrast which is the potential difference between the image portion potential and the DC bias or the blank pulse bias.

As described above, in Embodiment 1, the time of the DC developing voltage portion of the blank pulse portion was shortened, so that the electric charge accumulation of the magnetic chain end carrier was prevented and thus it became possible to prevent the image portion carrier deposition. However, e.g., the blank pulse is also used during the transparent toner image formation similarly as in the case of the color toner but a similar effect is obtained also by setting the pulse number of the blank pulse portion so as to be (time-wisely) shorter than that for the color toner.

Embodiment 2

FIG. 17 is a flow chart of control in Embodiment 2. In the control in this embodiment, similarly as in Embodiment 1, the rectangular wave is used as the AC voltage in the operation in the first image forming mode and the double blank pulse is used as the AC voltage in the operation in the second image forming mode. However, operations for discriminating the first image forming mode and the second image forming mode are made different from each other, so that an operation in a first fine-color mode in which the whole surface of the color image is covered with the transparent image and an operation in a second five-color mode in which only the white background portion of the color image is covered with the transparent image can be executed. Therefore, the device structure and the control other than that described above are identical to those in Embodiment 1 and will be omitted from redundant description.

In this embodiment, different from Embodiment 1 using the recording material cassette information, the developing condition with the transparent toner is switched on the basis of information on data of the image to be formed. By changing the developing voltage on the basis of the image data information, even with respect to the recording material fed from the first recording material cassette 10, it is possible to discriminate the image formation in which the transparent image is not superposed on the color image and the image formation in which the transparent image is superposed on the color image. In the image formation in which the transparent image is not superposed on the color image, the carrier deposition is not remarkable and therefore the glossiness fluctuation of the transparent image is suppressed by setting the developing condition using the WPB bias similarly as in the operation in the second image forming mode.

As shown in FIG. 9, the controller 69 displays the mode selecting screen of these image forming modes on a display 71 of the operating portion 70. When a user operates the operating portion 70, as shown in FIG. 10, the mode selecting screen is displayed on the display 71. The controller 69 inputs a print signal at the time when any one of "4-color mode", "5-color mode" and "only transparent (particular color) mode" is selected on the mode selection screen.

As shown in FIG. 17, the controller 69 obtains information on the color image data and the particular color image data which are used for image formation (S201).

The controller 69 judges whether or not the obtained image data information includes the color image data (S202). When the print signal shows the presence of the color image data, the controller 69 operates the pick-up roller 12, the separating roller 13 and the registration roller 14 in order to execute the operation in the first image forming mode (S203).

The controller 69 effects the 4 color-based color image printing on the recording material by the color image forming apparatus 101 (S204). The respective color toner images formed at the image forming portions PY, PM, PC and PK are transferred onto the recording material P via the intermediary transfer belt 26 and then the full-color toner image is fixed on the recording material P by the fixing device 15 (S205).

The controller 69 judges whether or not the obtained image data includes data of the area in which the transparent image is superposed on the color image (S206). When the obtained image does not include the data of the area, the controller 69 further judges that the print signal is that for the "4-color mode" or the "5-color mode" (S210). When the print signal is that for the "4-color mode" requiring no transfer image, the recording material P on which the color image is formed is discharged onto the discharge tray 39 via the non-image formation conveying portion 43 (S211).

When the print signal is that for the "5-color mode", the transparent toner image is formed on the photosensitive drum 1T in order to execute the operation in the second image forming mode in which the transparent toner image is printed on only the white background portion of the image which is not covered with the color image (S212). In the operation in the second image forming mode, the image portion carrier deposition is not problematic and therefore the developing device 4T uses the double blank pulse as the AC voltage to place priority on the developing property. The transparent toner image formed on the photosensitive drum 1T is transferred onto the recording material P, via the intermediary transfer belt 46, on which the color image is formed.

On the recording material P, the transparent image is fixed by the fixing device 35 (S213). The recording material P on which the transparent image is formed on the white background portion of the image is discharged onto the discharge tray 38 of the transparent image forming apparatus 102 (S214).

When the image data includes the data of the area in which the transparent image is superposed on the color image, the controller 69 forms the transparent toner image on the photosensitive drum 1T in order to execute the operation in the second image forming mode in which the superposing printing with the transfer primary is effected on the color image (S207). In this case, the developing device 4T develops the electrostatic image on the photosensitive drum 1T by using the rectangular wave AC voltage to prioritize the suppression of the carrier deposition. The transparent toner image formed on the photosensitive drum 1T is transferred, via the intermediary transfer belt 46, onto the whole surface of the recording material P on which the color image is formed in the color image forming apparatus 101.

On the recording material P on which the transparent toner image is transferred, the transparent image is fixed by the fixing device 35 (S208). The recording material P on which the transparent image is formed to cover the color image is discharged onto the discharge tray 38 of the transparent image forming apparatus 102 (S209).

The controller 69 operates, when the image data does not include the color image data information, the pick-up roller 32, the separating roller 33 and the registration roller 34 in order to execute the operation in the second image forming mode (S215).

The controller 69 forms the transparent toner image on the photosensitive drum 1T and primary-transfers the transparent toner image onto the intermediary transfer belt 46 by using the double blank pulse as the AC voltage of the developing voltage (S216). The transparent toner image is secondary-transferred onto the recording material P on which the fixed image is not formed. The recording material P on which the transparent toner image is secondary-transferred is subjected to the fixing of the transparent toner image by fixing device 35 (S217). The recording material P on which the transparent toner image is fixed is discharged on the discharge tray 38 of the transparent image forming apparatus 102 (S218).

In this embodiment, in the case where the transparent toner image is transferred and fixed on the fixed image of the color image, the carrier deposition becomes remarkable and therefore the carrier deposition degree is reduced by using the rectangular wave as the AC voltage during the development. However, in the case where the transparent image is formed on only the recording material and thus the transparent image is not superposed on the fixed image of the color image, the carrier deposition is not remarkable and therefore the halftone reproducibility is ensured by using the double blank pulse as the AC voltage during the development.

Embodiment 3

FIG. 18 is a graph for illustrating a developing voltage parameter used in Embodiment 3. In this embodiment, an amplitude of the AC voltage in the operation in the first image forming mode is made larger than that in the operation in the second image forming mode, so that the image portion carrier deposition is suppressed.

In Embodiments 1 and 2, the AC voltage waveform was made different between the operation in the first image forming mode and the operation in the second image forming mode. However, also with respect to the amplitude (peak-to-peak voltage Vpp) of the AC voltage which is another parameter of the developing voltage, there is sensitivity to the image portion carrier deposition.

As shown in FIG. 18, with an increase in amplitude (Vpp) of the AC voltage, the degree of the image portion carrier deposition tends to be improved. As shown in (a) of FIG. 13, it would be considered that this phenomenon is attributable to the increase in electric field intensity E in the developing nip thereby to accelerate the electric discharge from the magnetic chain end carrier m and thus the accumulated electric charge of the magnetic chain end carrier m is decreased to alleviate the image portion carrier deposition.

However, when the electric field intensity E in the developing nip is excessively large, the electrostatic image is disturbed by minute electric discharge to result in a problem of a lowering in thin line portion reproducibility. As shown in FIG. 14, when the value E×T exceeds the value of the peak of the image portion carrier deposition curve indicated by the broken line, the amount of electric charge transfer (electric discharge current) indicated by a solid line is abruptly increased, so that the electrostatic image cannot be precisely developed.

Therefore, in the case where the AC voltage amplitude in the operation in the first image forming mode is made larger than that in the operation in the second image forming mode, there is a need to set the AC voltage amplitude in a range so that the value E×T exceeds the peak value but is not so away from the peak value.

Here, the sensitivity to the image portion carrier deposition with respect to the AC voltage amplitude can be actually measured easily. Specifically, the image is actually formed by changing the AC voltage amplitude to estimate the image portion carrier deposition from a degree of the occurrence of the minute uneven glossiness on the output image. By performing this operation, it is possible to estimate that the magnetic chain end carrier belongs to what area in FIG. 14 at that time. Incidentally, the result of study in FIG. 18 is obtained by using the rectangular wave as a basic waveform of the AC voltage. However, a similar effect was obtained also by using the double blank pulse bias as the AC voltage.

In this embodiment, the amplitude of the AC voltage applied to the developing sleeve 51 of the developing device 4T is made different between the operation in the first image forming mode in which the transparent toner image is transferred and fixed on the fixed image and the operation in the second image forming mode in which the transparent toner image is transferred and fixed on the recording material. In either case, as the AC voltage, the double blank pulse is used but in the operation in the first image forming mode in which the uneven glossiness caused by the image portion carrier deposition is liable to become remarkable, the AC voltage amplitude is made larger than that in the operation in the second image forming mode. As a result, the occurrence of the image portion carrier deposition is suppressed, so that the occurrence of the minute uneven glossiness is prevented.

(1) AC Voltage Used in Operation in First Image Forming Mode

Frequency: 12 kHz
Vpp voltage: 2.2 KV
Waveform: double blank pulse rectangular wave
AC pulse number: 2 pulses/8 pulses
Blank pulse number: 6 pulses/8 pulses (2) AC voltage Used in Operation in Second Image Forming Mode Frequency: 12 kHz
Vpp voltage: 2.2 KV
Waveform: double blank pulse rectangular wave
AC pulse number: 2 pulses/8 pulses
Blank pulse number: 6 pulses/8 pulses According to the control in Embodiment 3, it became possible to reproduce the good gradation property with respect to the transparent toner image on the recording material P while suppressing the occurrence of the image portion carrier deposition when the transparent toner image is transferred and fixed on the fixed color image. As a result, it became possible to provide the high-quality output image with uniform glossiness.

Incidentally, the control in this embodiment may also be executed by the sequence similar to that in Embodiments 1 and 2. The AC voltage parameter may be set singly or in combination with that in Embodiment 1.

Embodiment 4

FIG. 19 is a graph for illustrating a developing voltage parameter used in Embodiment 4. In this embodiment, a frequency of the AC voltage in the operation in the first image forming mode is made smaller than that in the operation in the second image forming mode, so that the image portion carrier deposition is suppressed.

In Embodiment 3, the AC voltage amplitude was made different between the operation in the first image forming mode and the operation in the second image forming mode. However, also with respect to the frequency of the AC voltage which is another parameter of the developing voltage, there is sensitivity to the image portion carrier deposition.

As shown in FIG. 19, with a decrease in frequency of the AC voltage, the degree of the image portion carrier deposition tends to be improved. As shown in (a) of FIG. 13, it would be considered that this phenomenon is attributable to the low frequency of the AC voltage thereby to accelerate the electric discharge from the magnetic chain end carrier m in the developing nip and thus the accumulated electric charge of the magnetic chain end carrier m is decreased to alleviate the image portion carrier deposition.

However, when the AC voltage frequency is lowered, reciprocating motion of the toner is accelerated to increase the electric field for moving back the toner from the photosensitive drum 1T to result in a problem of a lowering in developing property. For this reason, in the case where the AC voltage frequency in the operation in the first image forming mode is made lower than that in the operation in the second image forming mode, there is a need to set the AC voltage frequency in a tolerable range which allows the lowering in developing property.

Here, the sensitivity to the image portion carrier deposition with respect to the AC voltage frequency can be actually measured easily. Specifically, the image is actually formed by changing the AC voltage frequency to estimate the image portion carrier deposition from a degree of the occurrence of the minute uneven glossiness on the output image. By performing this operation, it is possible to determine the frequency capable of simultaneously satisfying levels of the developing property and the carrier deposition. Incidentally, the result of study in FIG. 19 is obtained by using the rectangular wave as a basic waveform of the AC voltage. However, a similar effect was obtained also by using the double blank pulse bias as the AC voltage.

In this embodiment, the frequency of the AC voltage applied to the developing sleeve 51 of the developing device 4T is made different between the operation in the first image forming mode in which the transparent toner image is transferred and fixed on the fixed image and the operation in the second image forming mode in which the transparent toner image is transferred and fixed on the recording material. In either case, as the AC voltage, the double blank pulse is used but in the operation in the first image forming mode in which the uneven glossiness caused by the image portion carrier deposition is liable to become remarkable, the AC voltage frequency is made lower than that in the operation in the second image forming mode. As a result, the occurrence of the image portion carrier deposition is suppressed, so that the occurrence of the minute uneven glossiness is prevented.

(1) AC Voltage Used in Operation in First Image Forming Mode

Frequency: 8 kHz
Vpp voltage: 2.0 KV
Waveform: double blank pulse rectangular wave
AC pulse number: 2 pulses/8 pulses
Blank pulse number: 6 pulses/8 pulses (2) AC Voltage Used in Operation in Second Image Forming Mode Frequency: 12 kHz
Vpp voltage: 2.2 KV
Waveform: double blank pulse rectangular wave
AC pulse number: 2 pulses/8 pulses
Blank pulse number: 6 pulses/8 pulses According to the control in Embodiment 4, it became possible to reproduce the good gradation property with respect to the transparent toner image on the recording material P while suppressing the occurrence of the image portion carrier deposition when the transparent toner image is transferred and fixed on the fixed color image. As a result, it became possible to provide the high-quality output image with uniform glossiness.

Incidentally, the control in this embodiment may also be executed by the sequence similar to that in Embodiments 1 and 2. The AC voltage parameter may be set singly or in combination with that in Embodiment 1.

Embodiment 5

In Embodiments 1 to 4, the AC voltage parameters were made different between the operation in the first image forming mode and the operation in the second image forming mode. However, also with respect to a voltage value of the DC voltage (developing contrast) which is another parameter of the developing voltage, there is sensitivity to the image portion carrier deposition.

In this embodiment, the AC voltage of the developing voltage is common to the operations in the first and second image forming modes.

(1) AC Voltage Used in Operations in First and Second Image Forming Modes

Frequency: 12 kHz
Vpp voltage: 2.0 KV
Waveform: double blank pulse rectangular wave
AC pulse number: 2 pulses/8 pulses
Blank pulse number: 6 pulses/8 pulses However, in the operation in the first image forming mode, an absolute value of the DC voltage is made smaller than that in the operation in the second image forming mode. The DC voltage Vdc applied to the developing sleeve 51 in the operation in the first image forming mode is made smaller than the DC voltage Vdc applied to the developing sleeve 51 in the operation in the second image forming mode. As a result, the developing contrast Vcont in the operation in the first image forming mode is set at a value smaller than that of the developing contrast Vcont in the operation in the second image forming mode.

As shown in (a) of FIG. 13, when the electric field intensity E in the developing nip is large, the electric charge accumulation on the magnetic chain end carrier m is accelerated, so that the image portion carrier deposition is liable to be induced. In Embodiment 5, the developing contrast Vcont in the operation in the first image forming mode is set to be smaller than the developing contrast Vcont in the operation in the second image forming mode, so that the image portion carrier deposition is made less liable to occur.

(2) Developing Contrast in Operation in First Image Forming Mode

Light portion potential VL: −200 V
Dark portion potential VD: −530 V
DC voltage Vdc=−380 V
Developing contrast Vcont: 180 V
Fog removing contrast Vback: 150 V (3) Developing Contrast in Operation in Second Image Forming Mode Light portion potential VL: −200 V
Dark portion potential VD: −550 V
DC voltage Vdc=−400 V
Developing contrast Vcont: 200 V
Fog removing contrast Vback: 150 V

Embodiment 6

As shown in FIG. 1, the developing device 4T which is the example of the first developing device carries on the developing sleeve the magnetic brush of the developer containing the toner and the carrier and forms on the photosensitive drum 1Y the first toner image to be transferred onto the recording material surface. The developing device 4T which is the example of the second developing device carries on the developing sleeve the magnetic brush of the developer containing the toner and the carrier and forms on the photosensitive drum 1T the second toner image to be transferred onto the recording material surface on which the fixed image of the first toner image is formed.

In Embodiment 6, with respect to the developing device 4T, the developing condition in which probability of the transfer of the carrier from the developing sleeve onto the photosensitive drum is always lower than that with respect to the developing device 4Y is employed.

In Embodiments 1 to 6, the developing voltage parameter was switched with respect to the developing device 4T of the transparent image forming apparatus 102 shown in FIG. 1. However, in the image forming system 100, there is a high possibility that only the operation in the second image forming mode is executed by the developing devices 4Y, 4M, 4C and 4K of the color image forming apparatus 101 and the operation in the first image forming mode is executed by the developing device 4T of the transparent image forming apparatus 102.

Therefore, in Embodiment 6, the developing voltage for the operation in the second image forming mode is always set for the developing devices 4Y, 4M, 4C and 4K and the developing voltage for the operation in the first image forming mode is always set for the developing device 4T. With respect to the developing devices 4Y, 4M, 4C and 4K, the AC voltage and the DC voltage which permit the image portion carrier deposition are set at somewhat high levels while placing priority on the developing efficiency and developing quality other than the image portion carrier deposition. On the other hand, with respect to the developing device 4T, the AC voltage and the DC voltage which place priority on the suppression of the image portion carrier deposition even when the developing efficiency and developing quality other than the image portion carrier deposition are somewhat lowered.

In this embodiment, in accordance with Embodiment 5, the developing contrast Vcont during the transparent toner image formation is set to be smaller than that during the color image formation. The occurrence of the image portion carrier deposition during the transparent toner image formation in which these is much opportunity for forming a solid image is prevented, so that the occurrence of the minute uneven glossiness is prevented. Incidentally, although the developing contrast Vcont during the transparent toner image formation is decreased, the difference in toner height is slight from the viewpoint of alleviating the difference in toner height, so that the influence on the image quality is small.

As a result, it became possible to form a good high-density image with the color toner while suppressing the occurrence of the image portion carrier deposition during the transparent toner image formation, so that it because possible to provide a good image with a uniform glossiness.

Incidentally, the minute uneven glossiness is the image defect which is conspicuous on the high-density image with the high image ratio and therefore with respect to the developing device 4T, the developing condition for the operation in the first image forming mode may also be used only in the case of the high image ratio. Further, the developing contrast Vcont during the transparent toner image formation may also be lowered only in the case where the image ratio of the output product is estimated in advance from the image signal or the like and the output product is judged as including the image which is high in image ratio and provides conspicuous minute uneven glossiness.

The above operation is not limited to not only the operation for adjusting the DC voltage as in Embodiments 5 and 6 but also may also be applicable to the operation for adjusting the AC voltage as in Embodiments 1 to 4. It becomes possible to form a suitable image by properly select the developing condition in the operation in the first image forming mode depending on the image information.

Incidentally, the transparent toner is used for the purpose of eliminating the difference in glossiness between the image portion and the non-image portion to achieve the uniform glossiness over the entire image (the entire recording material surface). Further, the transparent toner is also used for the purpose of providing the gloss by eliminating the unevenness of the recording material surface to alleviate the difference in height between projections and recesses at the recording material surface, thus increasing the glossiness of the entire image. Further, in some cases, the transparent toner is used for the purpose of preventing an occurrence of breakage or crack of the toner image melt-fixed on the recording material when the recording material is bent or rubbed. For accomplishing these purposes, it is also possible to use white toner singly or in combination with the transparent toner.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 186372/2010 filed Aug. 23, 2010, which is hereby incorporated by reference.

What is claimed is:

1. A transparent toner image printing apparatus comprising:

a photosensitive member;

an exposing device configured to expose said photosensitive member based on image information to form an electrostatic image;

a developing device configured to develop the electrostatic image on said photosensitive member to form a transparent toner image using a two component developer;

a voltage applying device configured to apply a DC voltage biased with an AC voltage to said developing device;

a transferring device configured to transfer the transparent toner image on said photosensitive member onto a non-preprinted sheet or a preprinted sheet;

a fixing device configured to heat-fix the transparent toner image on the non-preprinted sheet or the preprinted sheet in a fixing nip thereof;

a selecting device configured to select one of a first mode in which the transparent toner image is formed on the preprinted sheet and a second mode in which the transparent toner image is formed on the non-preprinted sheet; and a controlling device configured to control an operation of said voltage applying device, wherein an amplitude of the AC voltage in the first mode is larger than an amplitude of the AC voltage in the second mode due to said controlling device.

2. A transparent toner image printing apparatus according to claim 1, wherein a regular charging polarity of a transparent toner is the same as a polarity of a charged surface potential of said photosensitive member.

3. A transparent toner image printing apparatus according to claim 2, wherein the two component developer includes a non-magnetic transparent toner and a magnetic carrier.

4. A transparent toner image printing apparatus comprising:

a photosensitive member;

an exposing device configured to expose said photosensitive member based on image information to form an electrostatic image;

a developing device configured to develop the electrostatic image on said photosensitive member to form a transparent toner image using a two component developer;

a voltage applying device configured to apply a DC voltage biased with an AC voltage to said developing device;

a transferring device configured to transfer the transparent toner image on said photosensitive member onto a non-preprinted sheet or a preprinted sheet;

a fixing device configured to heat-fix the transparent toner image on the non-preprinted sheet or the preprinted sheet in a fixing nip thereof;

a selecting device configured to select one of a first mode in which the transparent toner image is formed on the preprinted sheet and a second mode in which the transparent toner image is formed on the non-preprinted sheet; and a controlling device configured to control an operation of said voltage applying device, wherein a frequency of the AC voltage in the first mode is smaller than a frequency of the AC voltage in the second mode due to said controlling device.

5. A transparent toner image printing apparatus according to claim 4, wherein a regular charging polarity of a transparent toner is the same as a polarity of a charged surface potential of said photosensitive member.

6. A transparent toner image printing apparatus according to claim 5, wherein the two component developer includes a non-magnetic transparent toner and a magnetic carrier.

7. A transparent toner image printing apparatus comprising:

a photosensitive member;

an exposing device configured to expose said photosensitive member based on image information to form an electrostatic image;

a developing device configured to develop the electrostatic image on said photosensitive member to form a transparent toner image using a two component developer;

a voltage applying device configured to apply a DC voltage biased with an AC voltage to said developing device;

a transferring device configured to transfer the transparent toner image on said photosensitive member onto a non-preprinted sheet or a preprinted sheet;

a fixing device configured to heat-fix the transparent toner image on the non-preprinted sheet or the preprinted sheet in a fixing nip thereof;

a selecting device configured to select one of a first mode in which the transparent toner image is formed on the preprinted sheet and a second mode in which the transparent toner image is formed on the non-preprinted sheet; and a controlling device configured to control an operation of said voltage applying device, wherein a waveform of the AC voltage in the first mode is different from a waveform of the AC voltage in the second mode due to said controlling device.

8. A transparent toner image printing apparatus according to claim 7, wherein the waveform of the AC voltage in the first mode is a rectangular waveform having a blank portion every predetermined period, the waveform of the AC voltage in the second mode is a rectangular waveform having a blank portion every predetermined period, and a time period of the blank portion at every predetermined period in the first mode is shorter than a time period of the blank portion at every predetermined period in the second mode due to said controlling device.

9. A transparent toner image printing apparatus according to claim 7, wherein a regular charging polarity of a transparent toner is the same as a polarity of a charged surface potential of said photosensitive member.

10. A transparent toner image printing apparatus according to claim 9, wherein the two component developer includes a non-magnetic transparent toner and a magnetic carrier.

11. A transparent toner image printing apparatus comprising:

a photosensitive member;

an exposing device configured to expose said photosensitive member based on image information to form an electrostatic image;

a developing device configured to develop the electrostatic image on said photosensitive member to form a transparent toner image using a two component developer;

a voltage applying device configured to apply a DC voltage biased with an AC voltage to said developing device;

a transferring device configured to transfer the transparent toner image on said photosensitive member onto a non-preprinted sheet or a preprinted sheet;

a fixing device configured to heat-fix the transparent toner image on the non-preprinted sheet or the preprinted sheet in a fixing nip thereof;

a selecting device configured to select one of a first mode in which the transparent toner image is formed on the preprinted sheet and a second mode in which the transparent toner image is formed on the non-preprinted sheet; and a controlling device configured to control an operation of said voltage applying device;

wherein an absolute value of the DC voltage in the first mode is smaller than an absolute value of the DC voltage in the second mode due to said controlling device due to said controlling device.

12. A transparent toner image printing apparatus according to claim 11, wherein a regular charging polarity of a transparent toner is the same as a polarity of a charged surface potential of said photosensitive member.

13. A transparent toner image printing apparatus according to claim 12, wherein the two component developer includes a non-magnetic transparent toner and a magnetic carrier.

* * * * *